US008097101B2

(12) United States Patent
Dahle et al.

(10) Patent No.: US 8,097,101 B2
(45) Date of Patent: Jan. 17, 2012

(54) ALUMINIUM CASTING ALLOY

(75) Inventors: Arne Kristian Dahle, Kenmore Hills (AU); Liming Lu, Chapel Hill (AU); Kazuhiro Nogita, Jindalee (AU); Stuart David McDonald, Red Hill (AU)

(73) Assignee: Cast Centre Pty Ltd, St Lucia (AU)

( * ) Notice: Subject to any disclaimer, the term of this patent is extended or adjusted under 35 U.S.C. 154(b) by 592 days.

(21) Appl. No.: 11/720,729

(22) PCT Filed: Dec. 2, 2005

(86) PCT No.: PCT/AU2005/001826

§ 371 (c)(1),
(2), (4) Date: Aug. 18, 2009

(87) PCT Pub. No.: WO2006/058388

PCT Pub. Date: Jun. 8, 2008

(65) Prior Publication Data

US 2009/0297394 A1 Dec. 3, 2009

(30) Foreign Application Priority Data

Dec. 2, 2004 (AU) ..... 2004906910

(51) Int. Cl.
*C22F 1/043* (2006.01)
*C22C 21/04* (2006.01)

(52) U.S. Cl. ..... 148/437; 148/549; 420/549

(58) Field of Classification Search ..... 148/437, 148/549; 420/549

See application file for complete search history.

(56) References Cited

U.S. PATENT DOCUMENTS

| | | | | |
|---|---|---|---|---|
| 5,484,492 | A * | 1/1996 | Rogers et al. | 148/437 |
| 6,364,970 | B1 | 4/2002 | Hielscher | |
| 6,824,737 | B2 | 11/2004 | Koch | |
| 2004/0170523 | A1 | 9/2004 | Koch | |

FOREIGN PATENT DOCUMENTS

| | | | |
|---|---|---|---|
| CN | 1145412 | A | 3/1997 |
| EP | 0 601 972 | A1 | 6/1994 |
| EP | 1134299 | A1 | 9/2001 |
| WO | 91/02100 | A1 | 2/1991 |
| WO | 97/19200 | A1 | 5/1997 |
| WO | 2005/075692 | A1 | 8/2005 |

OTHER PUBLICATIONS

"Aluminum and Aluminum Alloys", ASM International, 1993, p. 623-627.*

(Continued)

*Primary Examiner* — Roy King
*Assistant Examiner* — Janelle Morillo
(74) *Attorney, Agent, or Firm* — Christensen O'Connor Johnson Kindness PLLC

(57) ABSTRACT

A method of forming a hypoeutectic aluminium silicon alloy including the steps of: forming an aluminium melt including greater than zero and less than about 12 wt % silicon, adding 20-3000 ppm of a eutectic modifying element selected from the group consisting of strontium, sodium, antimony, barium, calcium, yttrium, lithium, potassium, ytterbium, europium and mischmetal; and either adding nucleant particles and/or causing nucleant particles to be formed in the melt, the nucleant particles being selected from the group of TiSix, MnCx, AlP, AlBx and CrBx wherein x is an integer of 1 or 2.

10 Claims, 28 Drawing Sheets

OTHER PUBLICATIONS

Kashyap, K.T., and T. Chandrashekar, "Effects and Mechanisms of Grain Refinement in Aluminium Alloys," Bull. Mater. Sci. 24(4):345-353, Aug. 2001.

Nogita, K., et al., "Modification of Al-Si Alloys," in Jian-Feng Nie et al. (eds.), Material Forum 28:945-950, Institute of Materials Engineering Australasia Ltd, 2004.

* cited by examiner

ALUMINIUM CASTING ALLOY

FIELD OF THE INVENTION

This invention relates to an aluminium casting alloy and more particularly to a hypoeutectic aluminium silicon alloy for use in shape casting.

BACKGROUND OF THE INVENTION

Aluminium silicon alloys containing less than about 12% silicon are referred to as hypoeutectic alloys. In addition to alleviating the formation of defects such as hot tearing and porosity due to the shrinkage and gases, and also to minimising the presence of inclusions, two very significant ways in which the strength, ductility and performance of an aluminium casting alloy can be improved are through grain refinement of the primary aluminium phase and modification of the eutectic Al+Si structure. Upon cooling of molten hypoeutectic alloys, aluminium crystals form first through nucleation and growth, and later the second important event is the formation of the Al+Si eutectic mixture. It is understood that the (Al+Si) eutectic is an irregular and coupled eutectic, and it grows in the form of eutectic colonies, with silicon radiating from a single nucleating point and the tips of the silicon plates grow ahead of the aluminium, leading into the cooling liquid. It has been demonstrated that the (Al+Si) eutectic can nucleate on existing aluminium dendrites or substrate particles in the melt such as AlP, AlSiNa, $Al_2Si_2Sr$ and other unidentified particles.

Grain refinement of primary aluminium is simply the process of adding nuclei and solutes with a strong constitutional undercooling effect to the melt prior to pouring such that upon the freezing process (i.e. solidification) the casting will expedite a refined microstructure with small equiaxed aluminium crystals. Grain refinement of primary aluminium crystals is accomplished generally by adding master alloys containing titanium and/or boron to the melt.

Eutectic modification on the other hand is the process of changing the morphology of the cast structure and in particular, that portion of the cast structure which freezes as a eutectic mixture of aluminium and silicon towards the end of solidification. Unmodified hypoeutectic aluminium silicon alloys are relatively non ductile or brittle and consist of primary aluminium dendrites with eutectic composed of coarse acicular or plate-like silicon phase in an aluminium matrix. The morphology of these silicon rich crystals in the eutectic mixture can be modified by small additions of elements such as sodium, strontium or antimony to the melt to alter the eutectic structure and to yield silicon rich crystals having fine, fibrous structure. However the addition of modifiers has been found to neutralise the potent nuclei for the eutectic colonies in the melts resulting in a significant increase of the undercooling in eutectic nucleation and depression of the eutectic growth temperature. This in turn increases the eutectic grain size and reduces nucleation frequency in forming modified aluminium silicon alloys. Furthermore, modification of the aluminium silicon alloys has also been reported to cause pore redistribution and an increase in casting porosity.

It is an object of the present invention to provide a hypoeutectic aluminium silicon alloy having an improved microstructure with good castability and improved porosity characteristics.

SUMMARY OF THE INVENTION

Accordingly, in one aspect the invention provides a hypoeutectic aluminium silicon alloy wherein the eutectic is modified by a master alloy consisting of an element selected from strontium, sodium, antimony, barium, calcium, yttrium, lithium, potassium, ytterbium and rare earth elements such as europium, mischmetal, such as lanthanum, cerium, praseodynium and neodynium and further refined by the addition of a master alloy containing nucleant particles for the eutectic colonies. It is preferable that the nucleant particles are selected from the group consisting of $TiSi_x$, $MnC_x$, AlP, $AlB_x$, and $CrB_x$ which are added as particles or formed in situ in the melts. These nucleant particles promote a small eutectic grain size without altering fine fibrous silicon crystal structure.

In a preferred embodiment of the invention, the nucleant particles have a particle size of less than 100 μm and preferably less than 10 μm. The nucleant particles are preferably added to the melt by way of a master alloy containing the nucleant particles or formed in situ in the melts through preferred reactions, such as reactions between melt and master alloys.

In one aspect of the invention, there is provided a method of forming a hypoeutectic aluminium silicon alloy including the steps of:

forming an aluminium melt including adding greater than zero and less than about 12 wt % silicon, 20-3000 ppm, preferably 150-3000 ppm of a eutectic modifying element selected from the group consisting of strontium, sodium, antimony, barium, calcium, yttrium, lithium, potassium, ytterbium, europium and mischmetal, such as lanthanum, cerium, praseodynium and neodynium, more preferably 20-300 ppm when the eutectic modifying element is sodium, 50-300 ppm when the eutectic modifying element is strontium, 1000-3000 ppm when the eutectic modifying element is antimony; and either adding nucleant particles and/or causing nucleant particles to be formed in the melt, the nucleant particles being selected from the group of $TiSi_x$, $MnC_x$, AlP, $AlB_x$ and $CrB_x$ where x is an integer, 1 or 2.

The applicant has found that by the addition or in situ formation of these nucleant particles into a hypoeutectic aluminium silicon alloy modified by one of the elements referred to above, a modified aluminium silicon alloy having reduced porosity is produced. Furthermore, fine silicon rich crystals having a fibrous eutectic structure are produced.

In the case of $CrB_x$, the addition rate of these particles to the melt was preferably greater than 2 wt %.

The applicant has found that the above mentioned colony refining additions are not affected by the presence of eutectic modification additions or vice versa if the addition conditions are controlled properly. Hence the $TiSi_x$, $MnC_x$, AlP, $CrB_x$ and $AlB_x$ present are able to act as nucleant particles for eutectic colonies.

In another aspect of the invention, there is provided an aluminium silicon alloy including:

greater than zero and less than about 12 wt % silicon 20-3000 ppm, preferably 150-3000 ppm of eutectic modifying element selected from the group consisting of strontium, sodium, antimony, barium, calcium, yttrium, lithium, potassium, ytterbium, europium and mischmetal such as lanthanum, cerium, praseodynium and neodynium preferably 20-3000 ppm when the eutectic modifying element is sodium; and balance aluminium;

wherein eutectic grains are formed around nucleant particles being selected from the group consisting of $TiSi_x$, $MnC_x$, AlP, $AlB_x$ and $CrB_x$ where x is an integer of 1 or 2.

In a further aspect, there is provided use of a hypoeutectic alloy to produce an as cast material, the alloy consisting essentially of:

less than about 12 wt % silicon, 20-3000 ppm, preferably 150-3000 ppm of a eutectic modifying element selected from the group consisting of:

strontium, sodium, antimony, barium, calcium, yttrium, lithium, potassium, ytterbium, europium and mischmetal, such as lanthanum, cerium, praseodynium and neodynium, more preferably 20-300 ppm when the eutectic modifying element is sodium, 50-300 ppm when the eutectic modifying element is strontium, 1000-3000 ppm when the eutectic modifying element is antimony; and balance aluminium;

wherein eutectic grains are formed around nucleant particles being selected from the group consisting of $TiSi_x$, $MnC_x$, AlP, $AlB_x$ and $CrB_x$ where x is an integer of 1 or 2.

BRIEF DESCRIPTION OF THE DRAWINGS

FIG. 1(*a*) is the base alloy, 1(*b*) is the base alloy with the addition of 300 ppm Sr, 1(*c*) is the base alloy modified with Sr and with 2% $CrB_x$ addition with 1(*d*) the micrograph of a section of FIG. 1(*c*). FIG. 1(*f*) is the macrograph of base, modified with Sr and 4% $CrB_x$ addition and FIG. 1(*e*) is the micrograph of a section of FIG. 1(*f*);

DETAILED DESCRIPTION OF THE PREFERRED EMBODIMENT

Figure 1A:
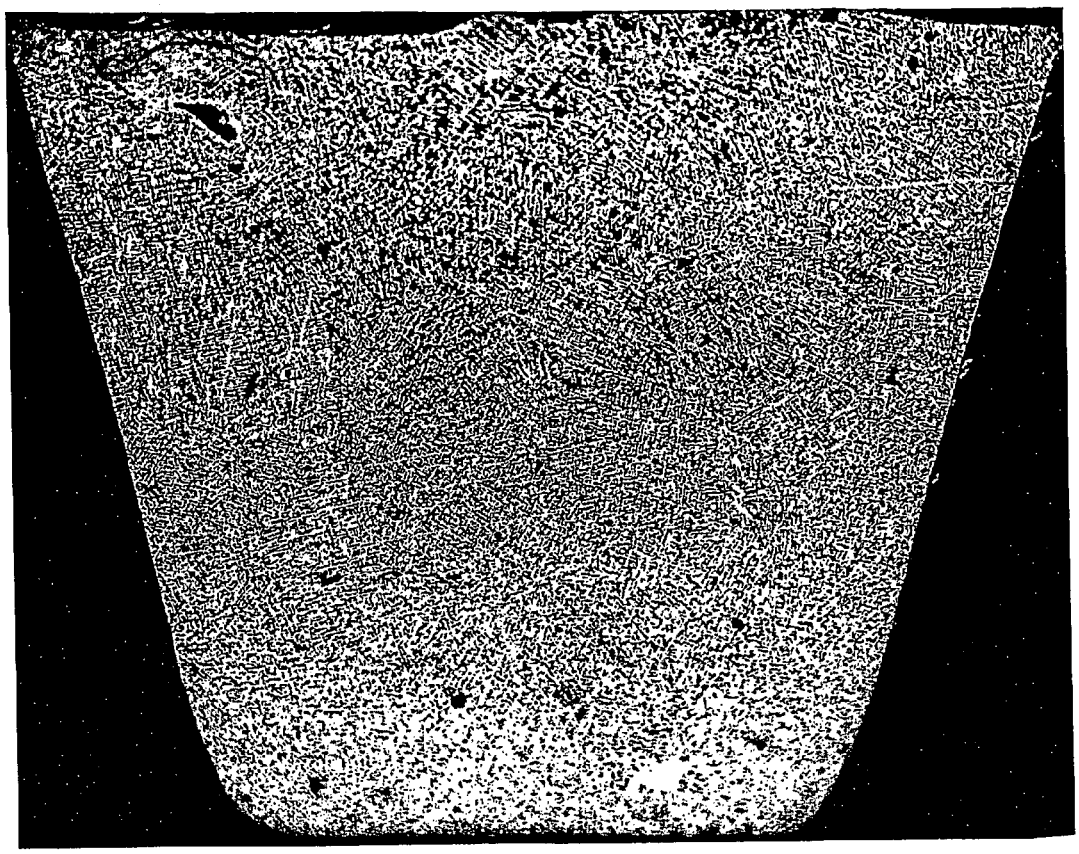
FIGS. 1(*a*)-1(*d*) show micrographs of quenched and fully solidified samples.
Figure 1B:
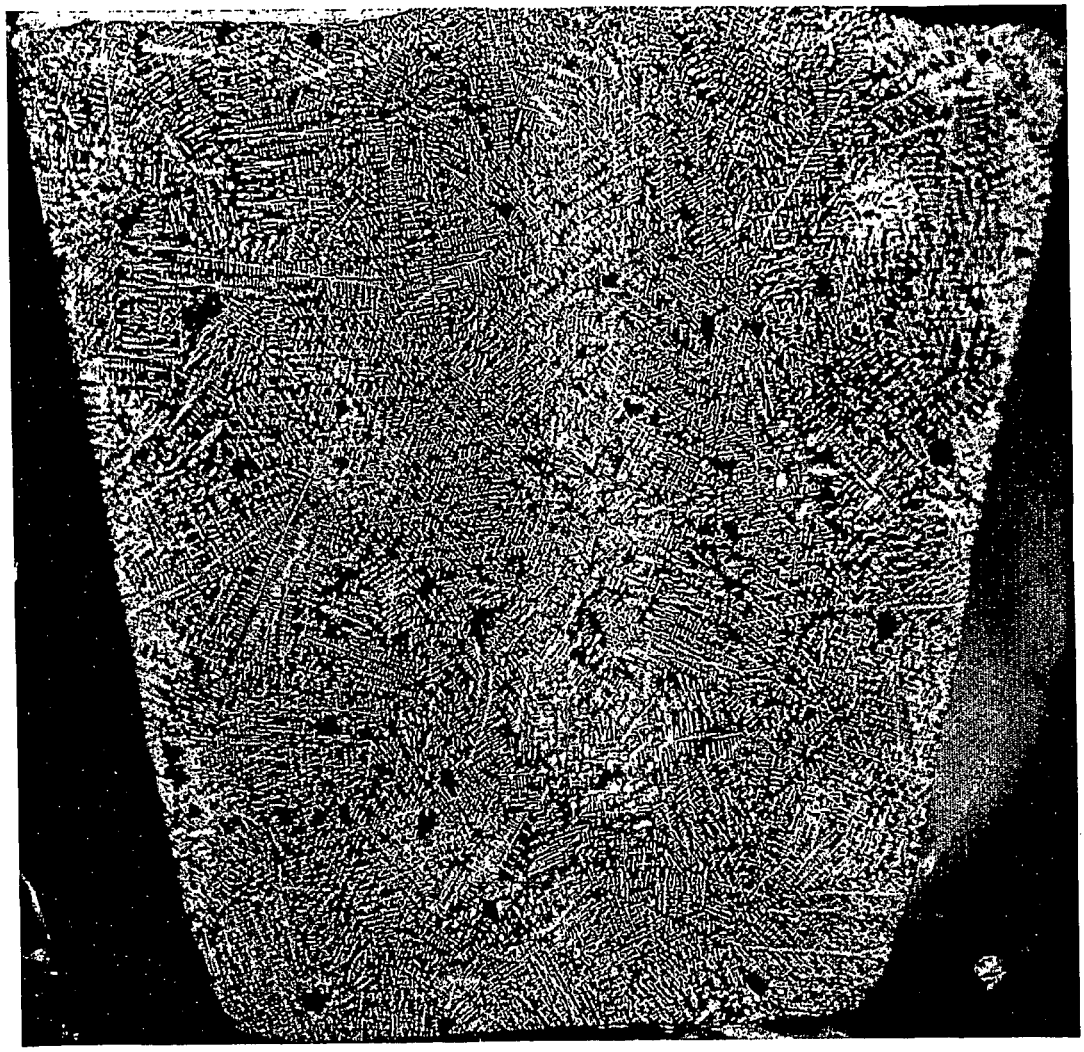
Figure 1C:
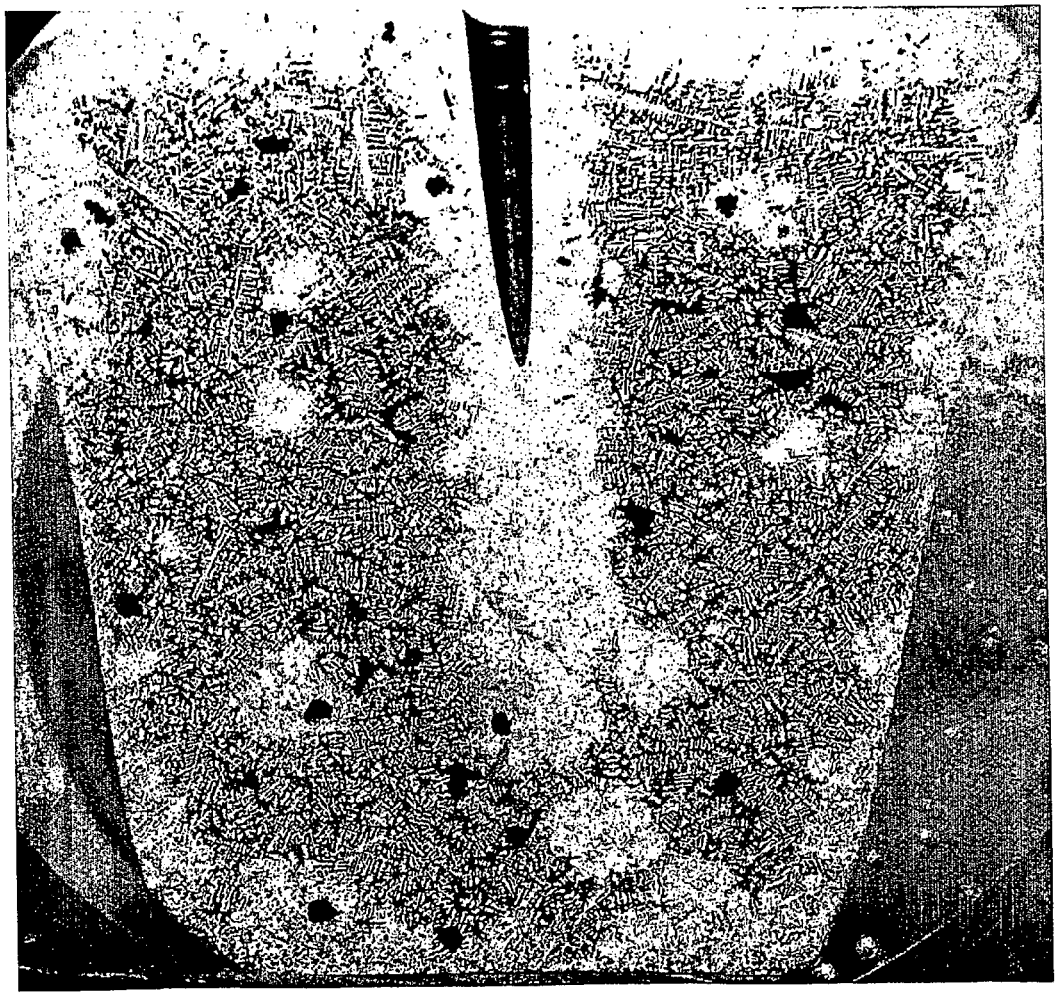
Figure 1D:
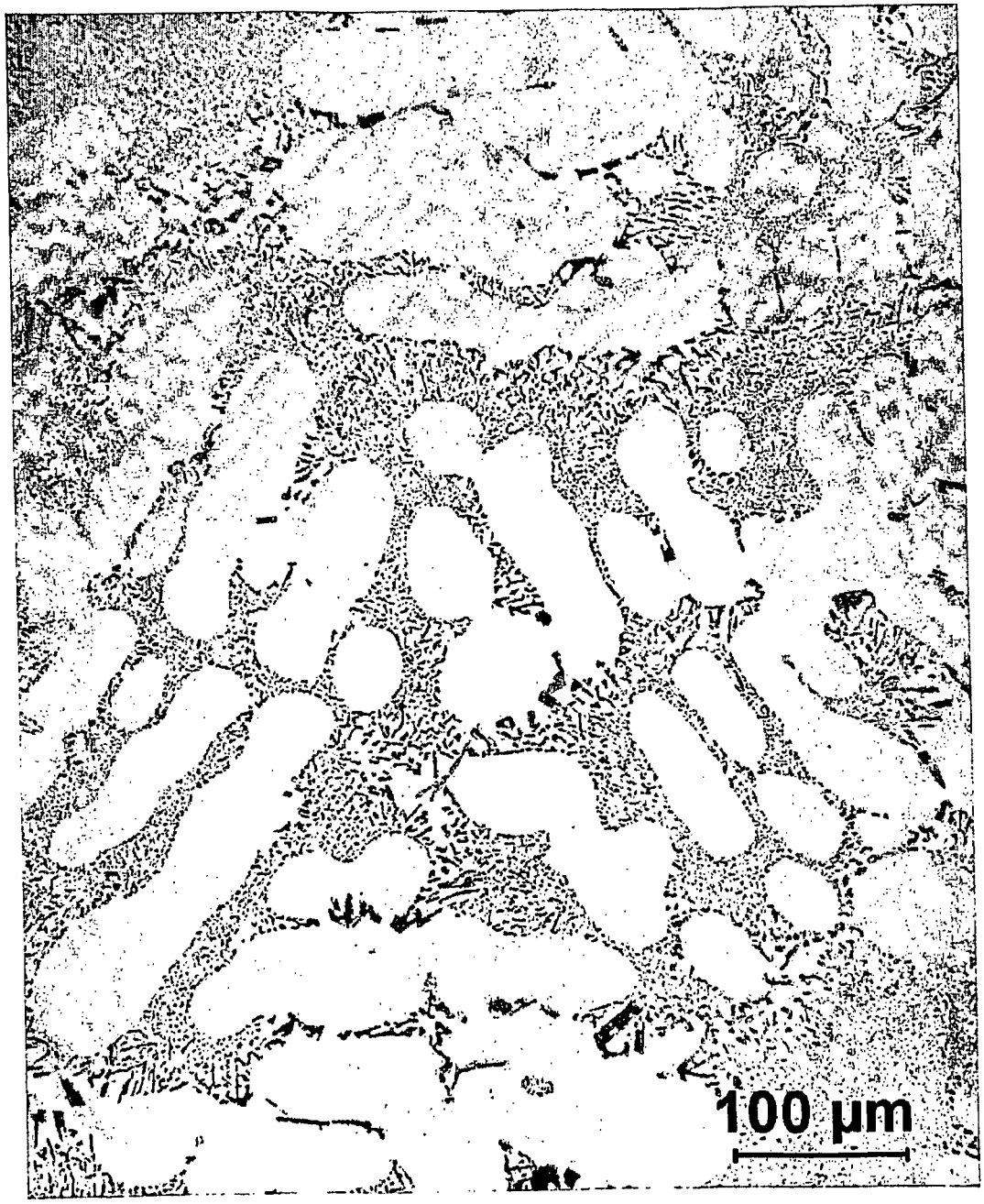
Figure 1E:
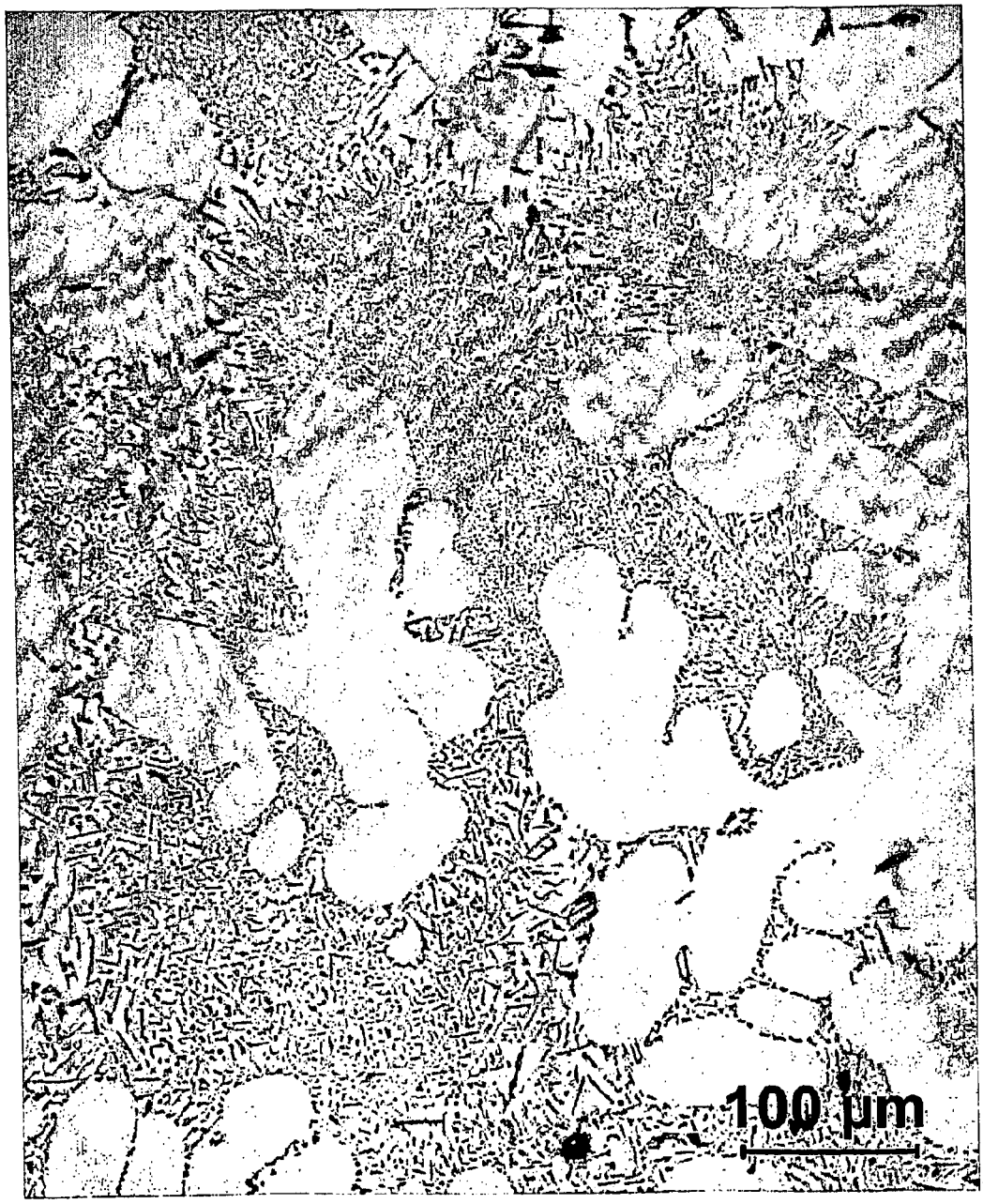
Figure 1F:
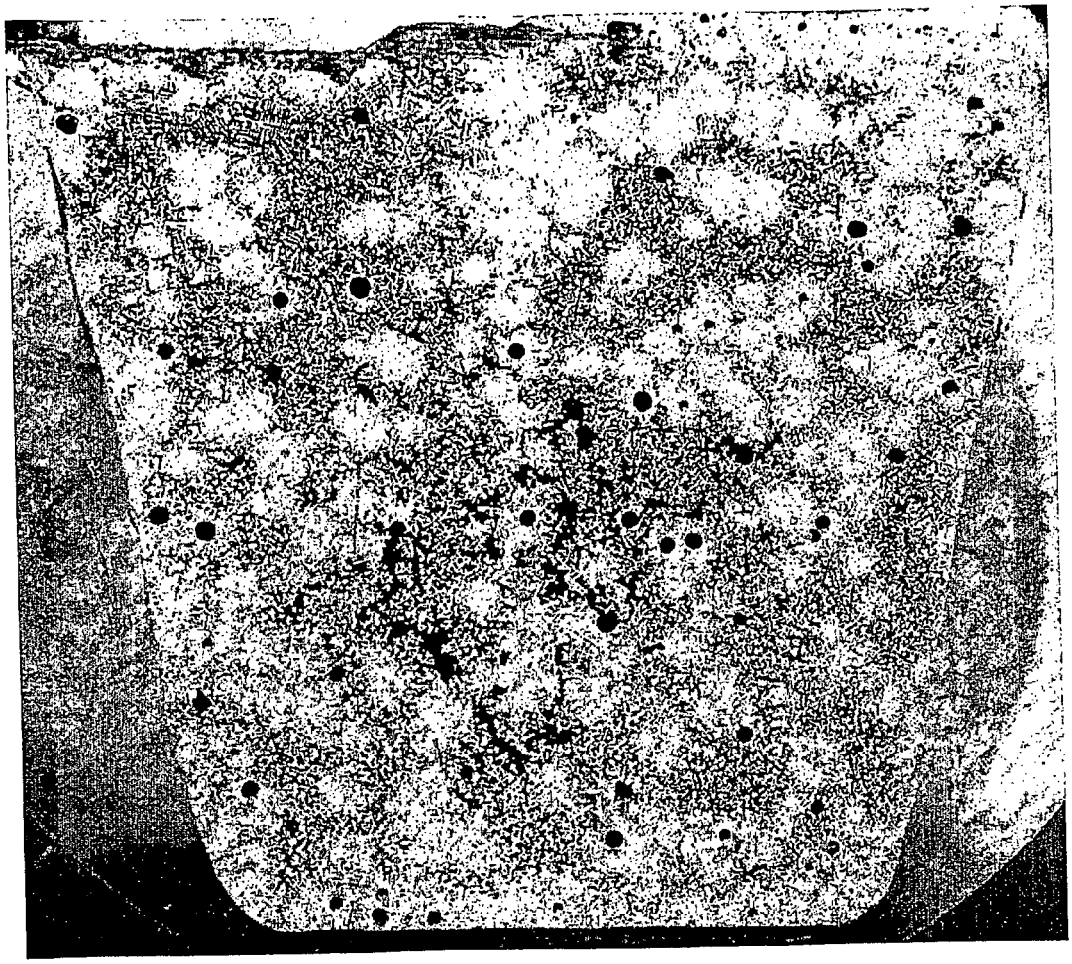

It will be understood that the invention disclosed and defined in this specification extends to all alternative combinations of two or more of the individual features mentioned or evident from the text or drawings. All of these different combinations constitute various alternative aspects of the invention.

An Al-10% Si-0.35% Mg alloy unless otherwise specified, was selected as a base alloy and it was prepared from commercial purity aluminium, silicon and magnesium in an induction furnace. After being held at about 750° C. for 10 minutes for homogenization, the base alloy melt was transferred to an electric resistance furnace, which was held at 730° C. After reaching thermal equilibrium, the melt was modified first by the addition of a refining element such as Sr, to neutralize the potent nuclei present in the melt. Weighted trial master alloy was then added to introduce or form new nuclei in situ in the melt. The melt was stirred twice after each addition. All additives were dried in an oven at 300° C. and then wrapped in aluminium foil before addition to ensure that they dissolved properly and evenly throughout the melt.

Thermal analysis and quenching trials were usually performed prior to and after eutectic modification as well as after addition of trial master alloys. Thermal analysis was performed first using a preheated graphite crucible and a centrally located, stainless steel-sheathed Type N thermocouple to help develop a strategy for the following quenching trials. The cooling rate for thermal analysis was about 1° C./s just prior to nucleation of the first solid. Two interrupted quenching tests, corresponding to the beginning and middle stages of eutectic solidification, were then carried out using a special stainless steel quenching cup sitting either in an insulation brick or in the air.

Samples for chemical analysis were also collected after each addition and prepared according to Australian standard (AS 2612) and analysed using a bench top spark optical emission spectrometer. For microstructural observation, the quenched samples were sectioned vertically along the thermocouple line while fully solidified TA samples were sectioned horizontally at the level of the thermocouple. Metallographic samples were mounted in resin and prepared using a standard procedure with a final polishing stage of 0.05 μm colloidal silica suspension. The macrographs were taken from etched samples using a high-resolution digital camera under indirect illumination conditions. The micrographs were taken in the median region of the section, 10 mm away from the bottom of the unetched samples.

Potential Nucleating Particles and Trial Master Alloys

It is understood that the (Al+Si) eutectic is an irregular and coupled eutectic, and it grows in the form of eutectic colonies, with silicon radiating from a single nucleating point and the tips of the silicon plates grow ahead of the aluminium, leading into the cooling liquid. It has been demonstrated that the (Al+Si) eutectic can nucleate on existing aluminium dendrites or substrate particles in the melt.

Since Si is generally believed to be the leading phase in (Al+Si) eutectic, the nucleation of the eutectic therefore comes to the nucleation of Si. Based on our knowledge of known nucleants and lattice mismatch, a list of potential nucleating particles for the eutectic colonies were compiled. Three particles including $TiSi_x$, $CrB_x$, $MnC_x$ were further selected from the list, and trial master alloys containing these three particles have been manufactured. During the implementation of this project, two more particles, $AlB_x$, and AlP, have been further included in the test. Table 1 lists all the potential nucleating particles tested and the corresponding trial master alloys. While most nucleating particles are assumed to be present in the trial master alloys, some others have to form in-situ in the melts after addition of trial master alloys.

TABLE 1

Potential Nucleating Particles and Trial Master Alloys

| Potential nucleating particles | Trial master alloys | Comments |
|---|---|---|
| $TiSi_x$ | Z6904C | Potential nucleating particles already present in the master alloys |
| $CrB_x$ | R2513A | |
| $MnC_x$ | R2514A | |
| $AlB_x$ | Al—3%B commercial alloys | |

TABLE 1-continued

| Potential Nucleating Particles and Trial Master Alloys | | |
|---|---|---|
| Potential nucleating particles | Trial master alloys | Comments |
| AlP | AlCuP | Nucleant particles to be formed in situ in the melts after addition of this trial master alloy |

EXAMPLE 1

A number of tests have been conducted with different addition levels of three trial alloys separately containing the nucleant particles $TiSi_x$, $CrB_x$ and $MnC_x$. Among these master alloys, the alloy with $CrB_x$ particles appears effective in nucleating the eutectic Si. Three repetitive tests have been conducted for this master alloy alone. It appears this master alloy is effective only at an addition level exceeding 2 wt % (or according to calculation, there is about 2.5 wt % $CrB_x$ in the master alloy. Therefore it is expected to have 0.5 g $CrB_x$ in 1000 g melt at this addition level). This is likely because the number of potent nuclei is not very high in the master alloy itself. Nevertheless this demonstrates the potency of the $CrB_x$ particles present in this particular trial master alloy. These particles measured using laser diffraction technique had a volume weighted mean diameter of 5 μm. While the general trend was found in all three tests (ie. volume weighted mean diameter of 5 μm), the degree of increase in nucleation frequency achieved varies. This may also suggest that the master alloy is not very uniform. FIG. 1 shows macrographs of quenched samples and the micrographs of fully solidified samples. FIG. 1(*a*) is the base alloy, 1(*b*) is the base alloy with the addition of 300 ppm Sr, 1(*c*) is the base alloy modified with Sr and with 2% $CrB_x$ addition with 1(*d*) the micrograph of a section of FIG. 1(*c*). The white spots on the macrographs represent eutectic grains. FIG. 1(*f*) is the macrograph of base, modified with Sr and 4% $CrB_x$ addition and FIG. 1(*e*) is the micrograph of a section of FIG. 1(*f*)

From the results in FIG. 1, it is clear that there has been a significant increase in eutectic nucleation frequency following the addition of $CrB_x$ master alloy to the Sr-modified alloy while maintaining a modified, fibrous, eutectic silicon morphology.

Figure 2A:
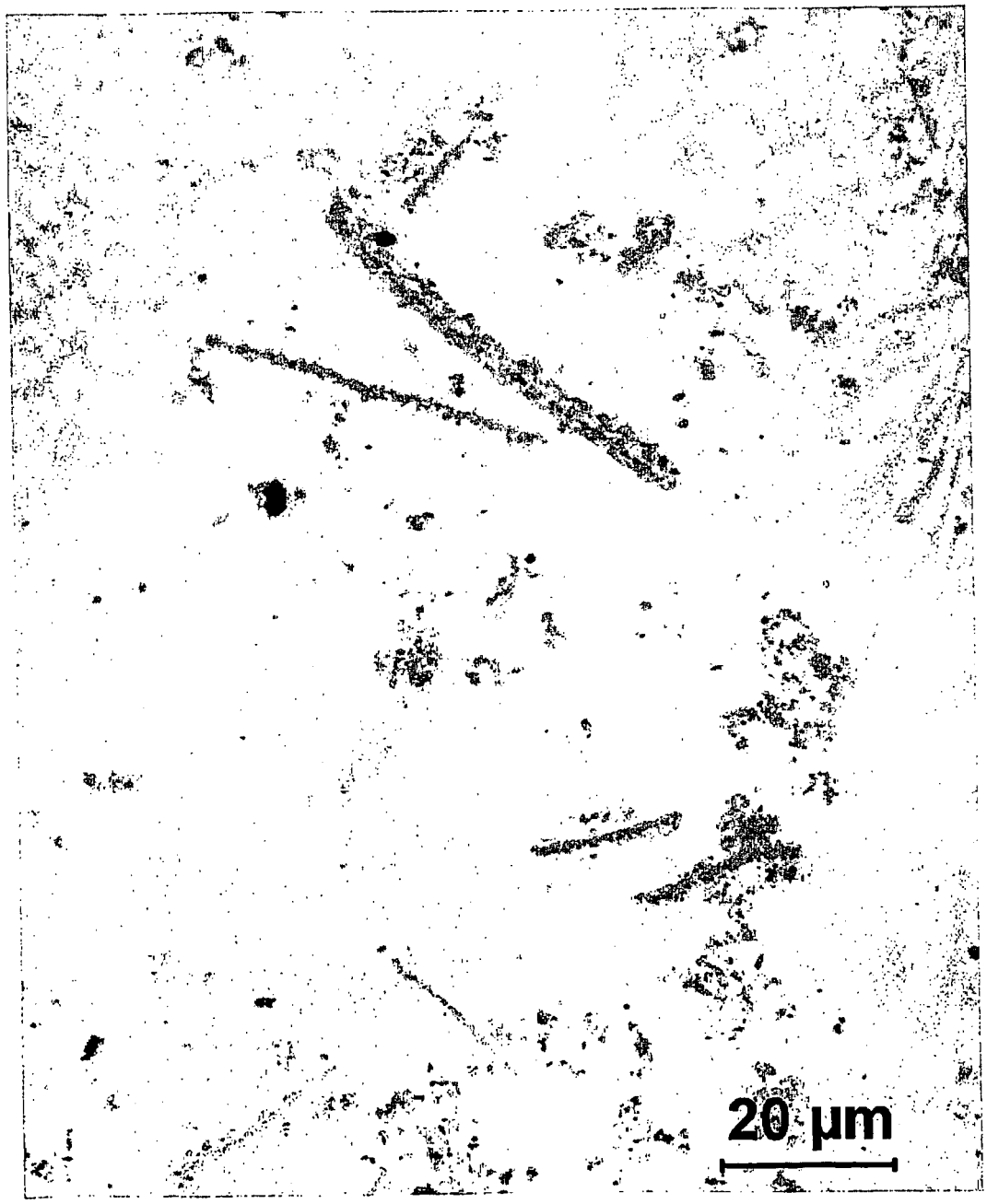
FIG. 2 illustrates the microstructures of master alloy additives of (a) CrB, (b) MnC and (c) TiSi.
Figure 2B:
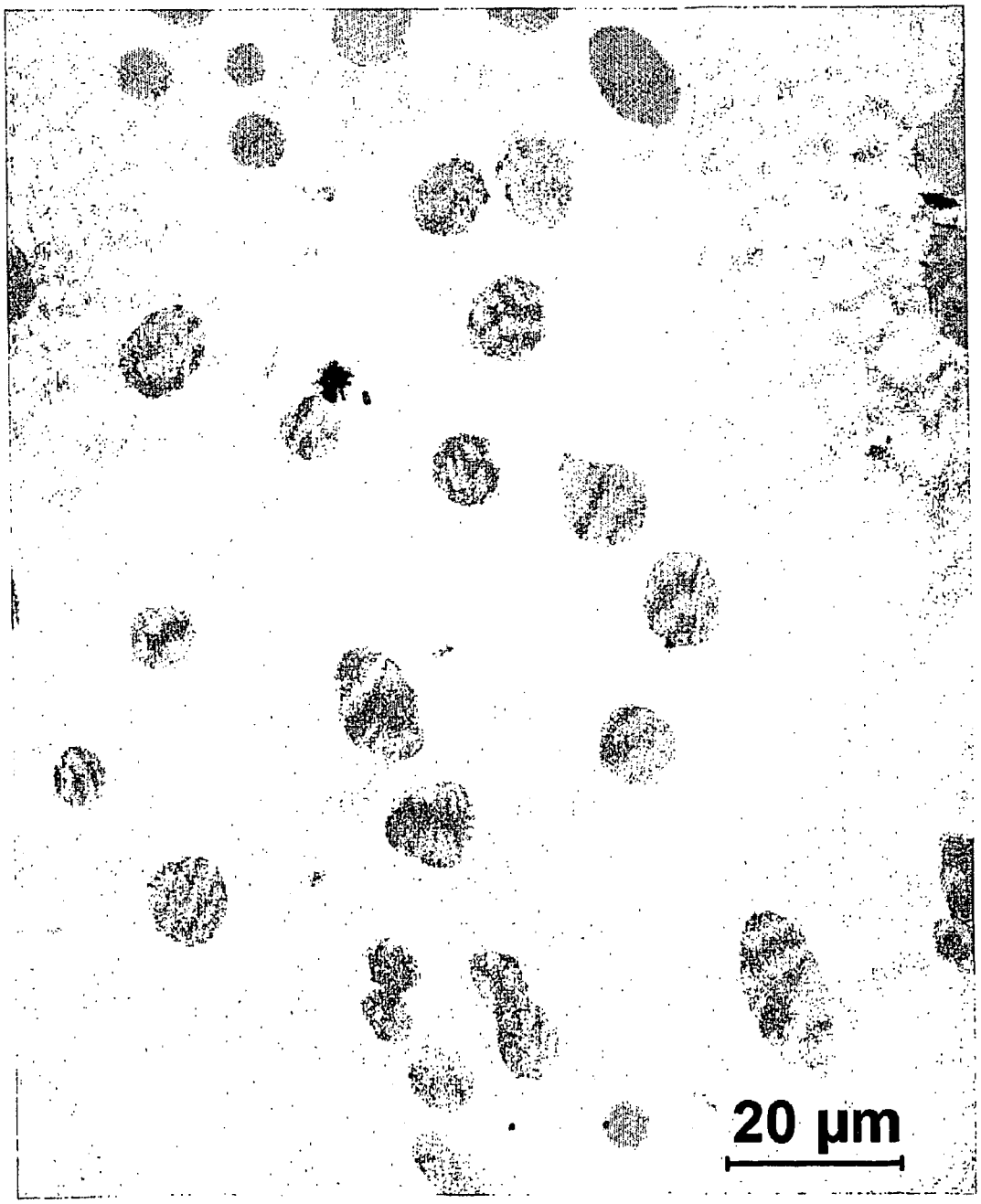
Figure 2C:
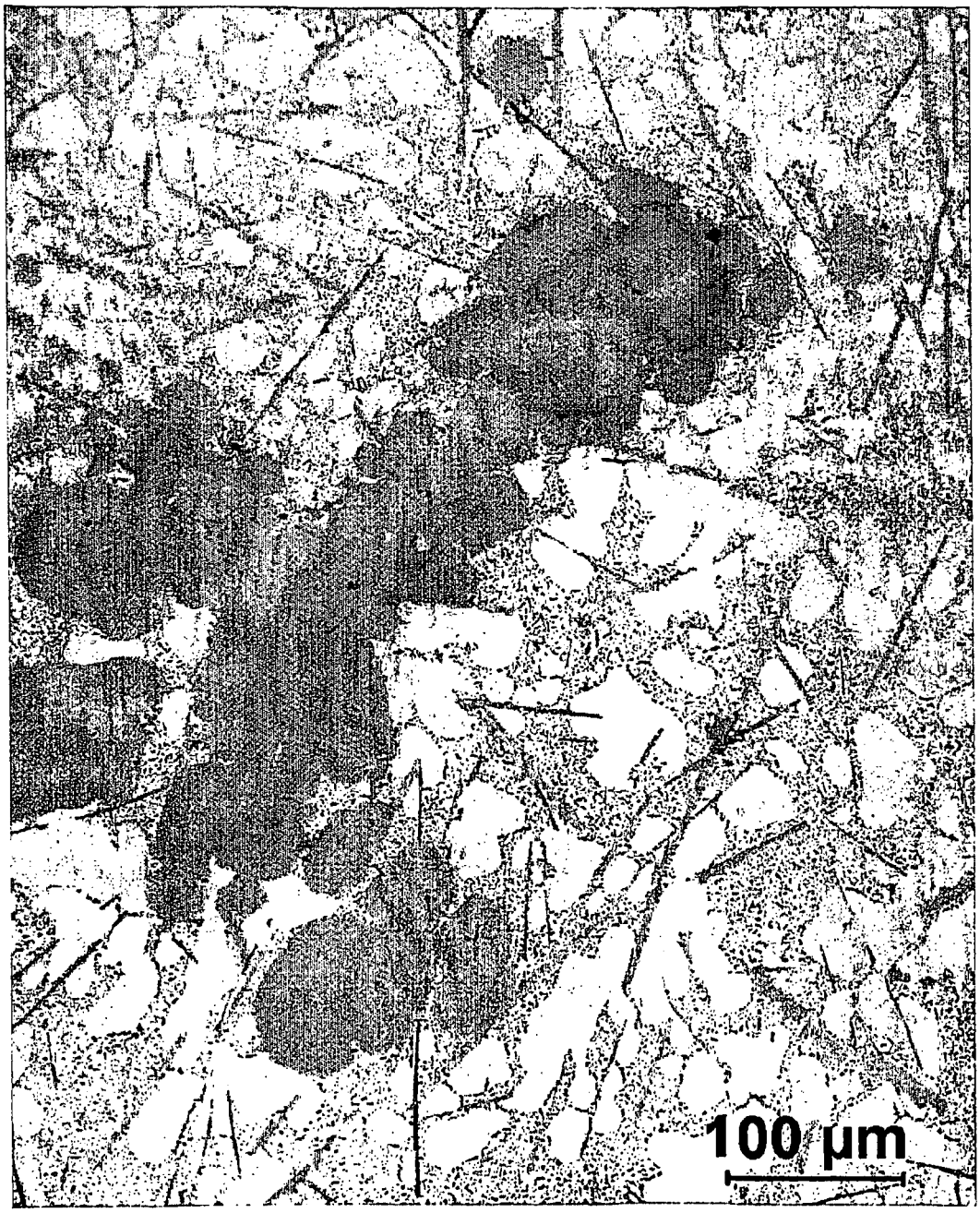
Figure 3A:
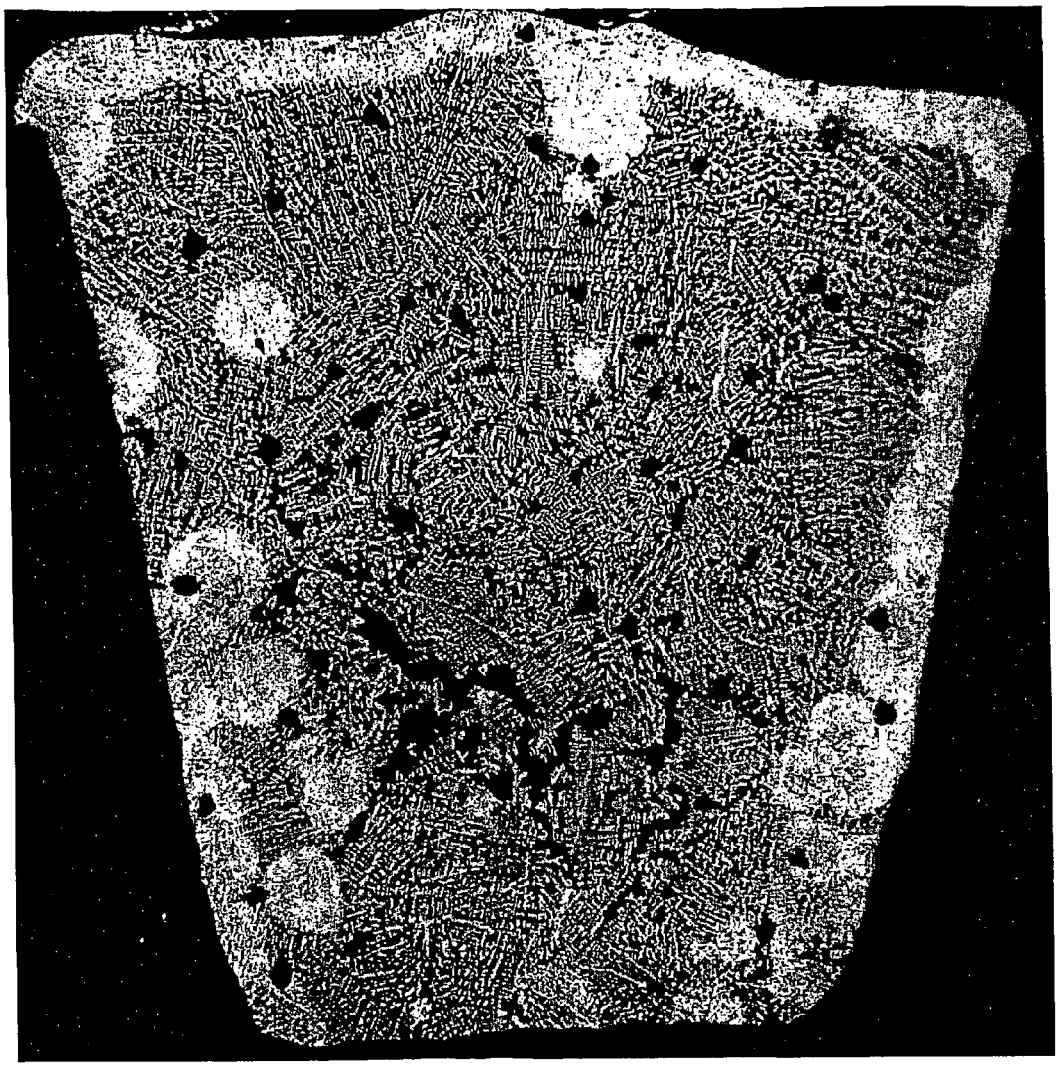
FIG. 3 are macrographs of quenched samples and micrographs of fully solidified samples of different levels of phosphorus addition to Sr modified Al 10% Si alloys.
Figure 3B:
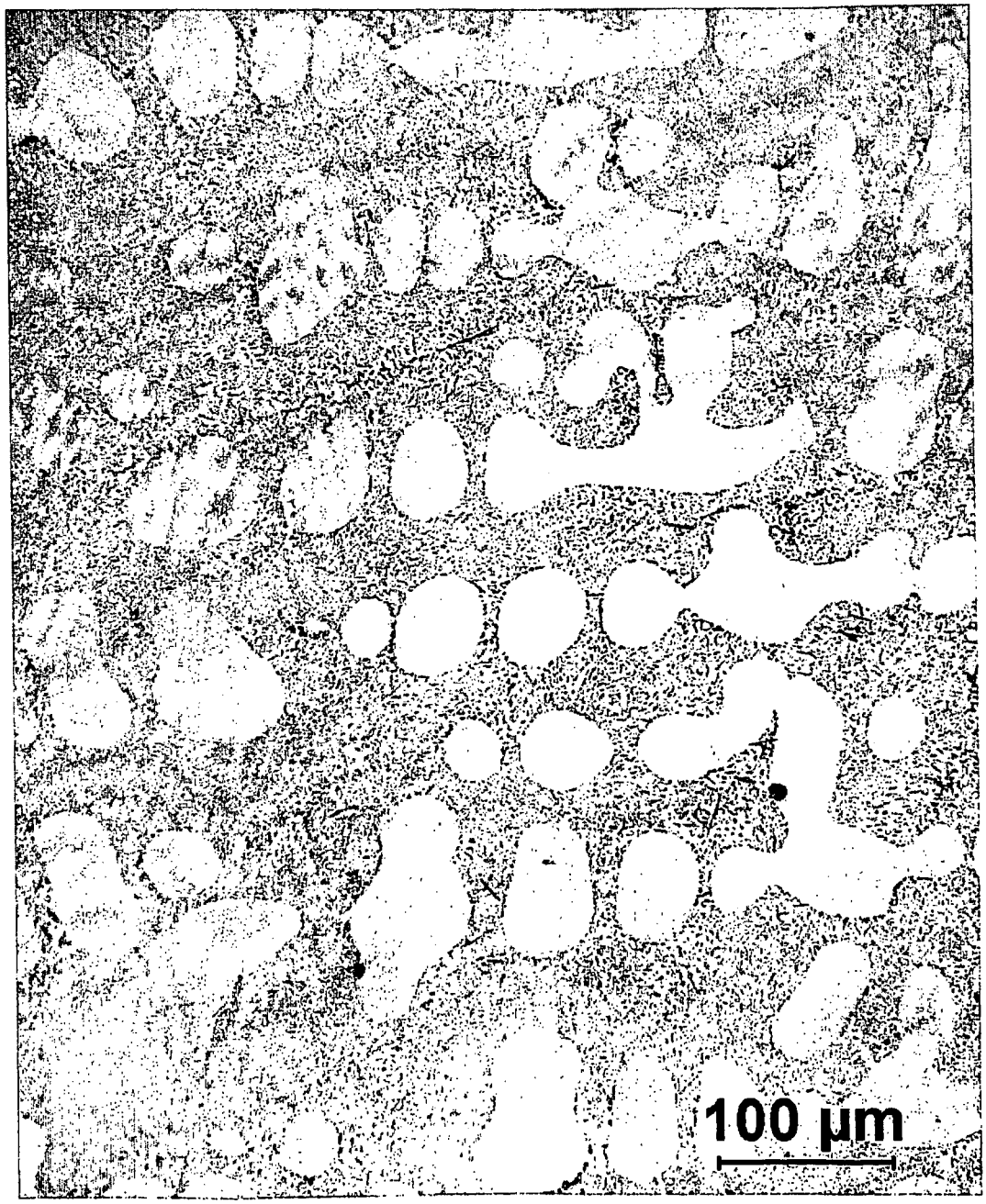
Figure 3C:
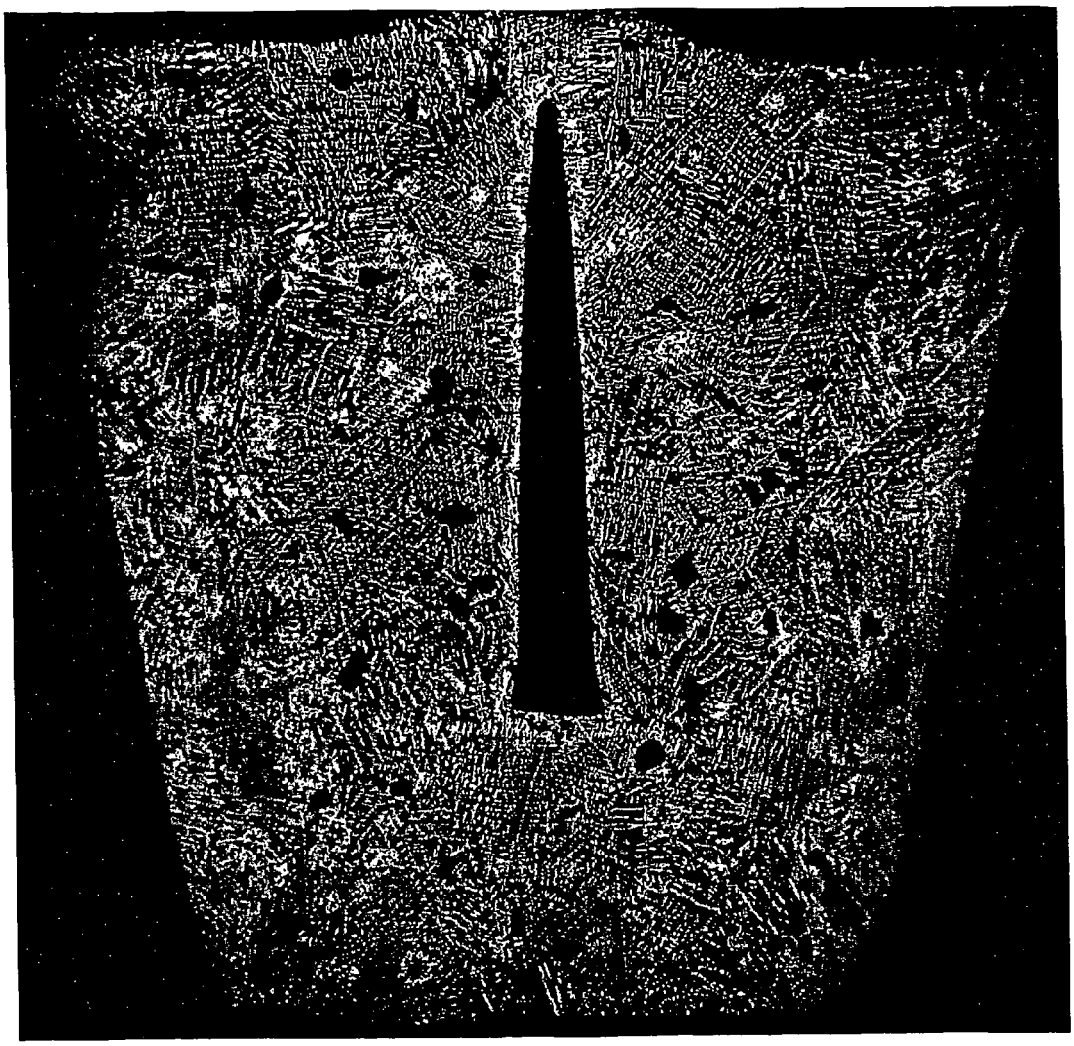
Figure 3D:
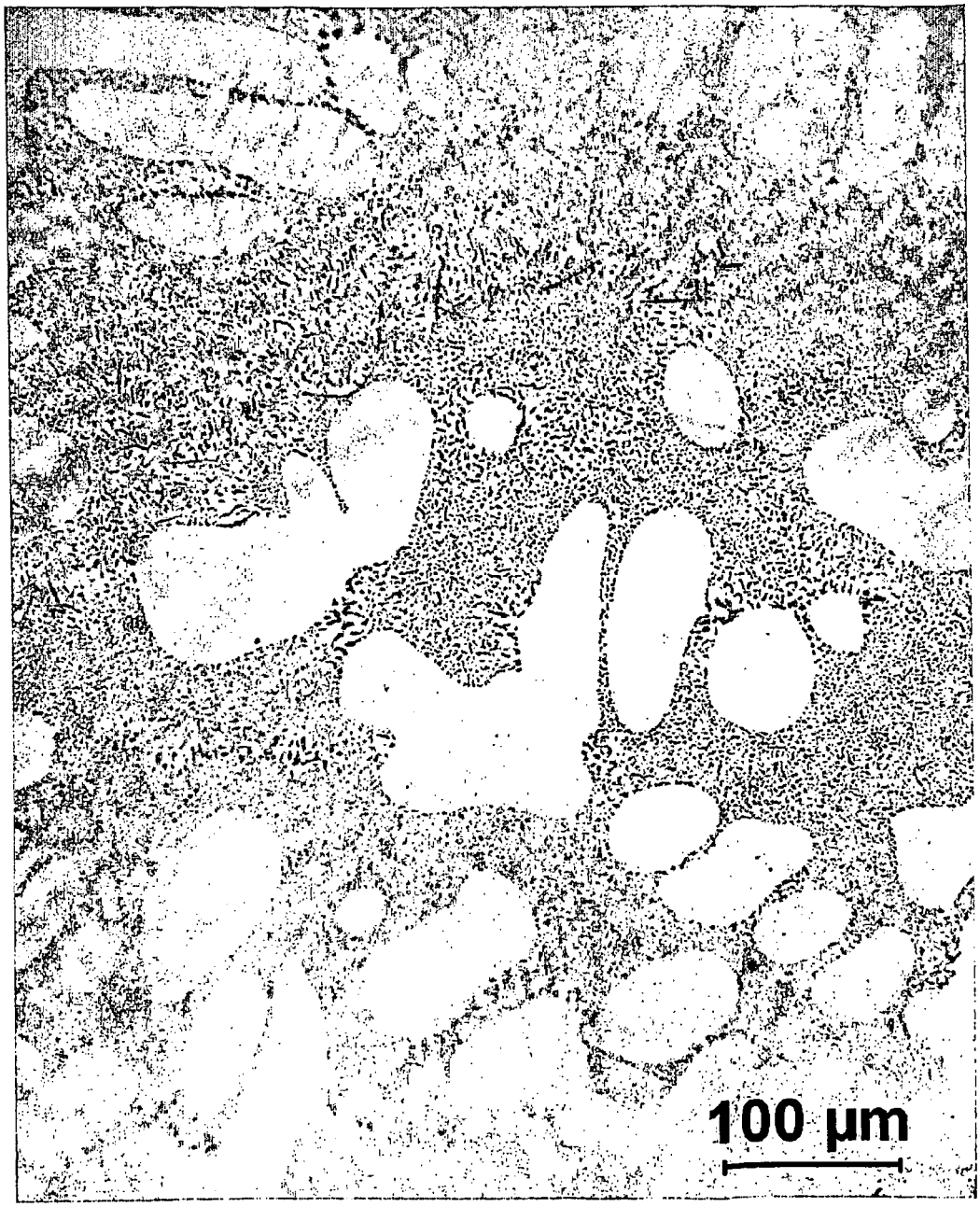
Figure 4A:
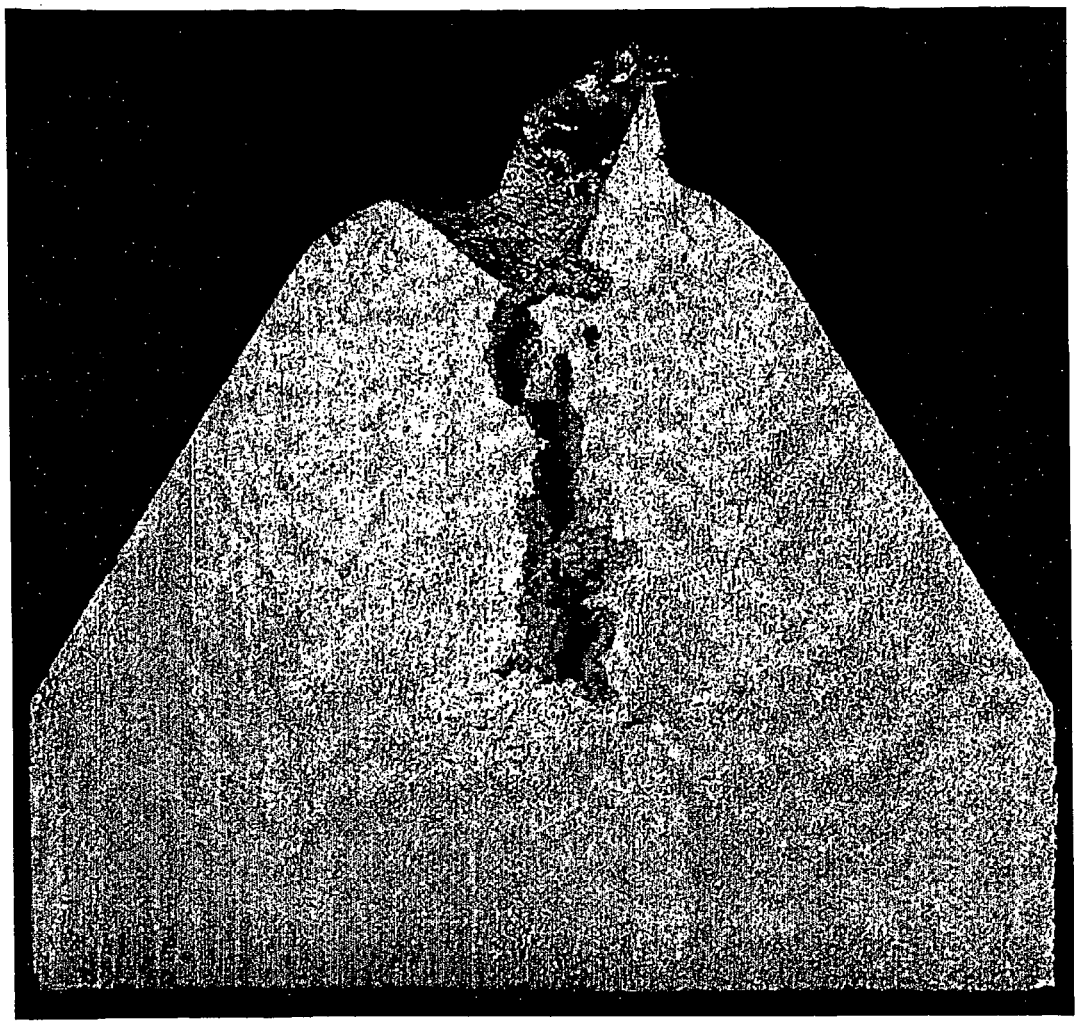
FIG. 4 are macrographs of Tatur castings cast from melts of unmodified and Sr modified with varying phosphorus addition levels.
Figure 4B:
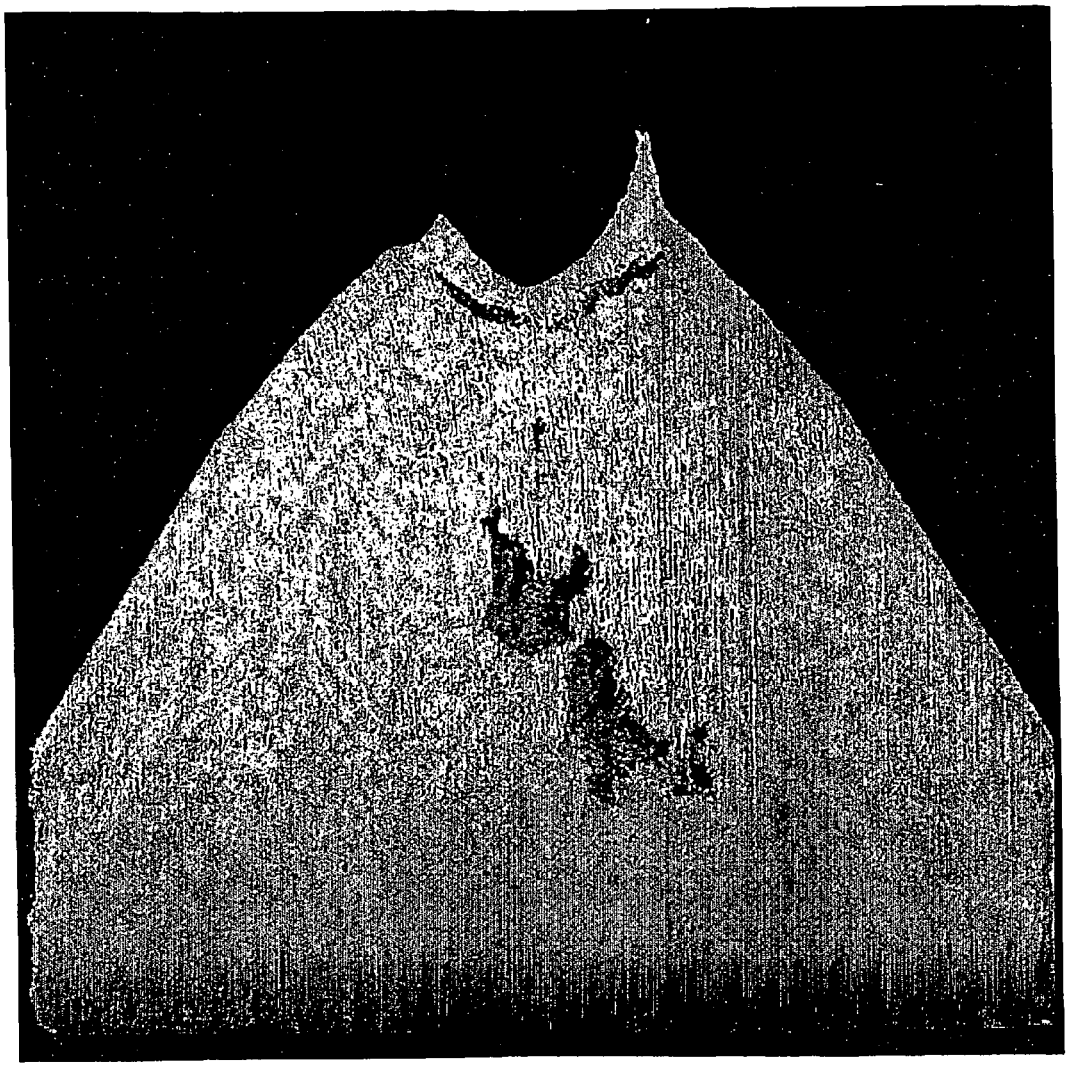
Figure 4C:
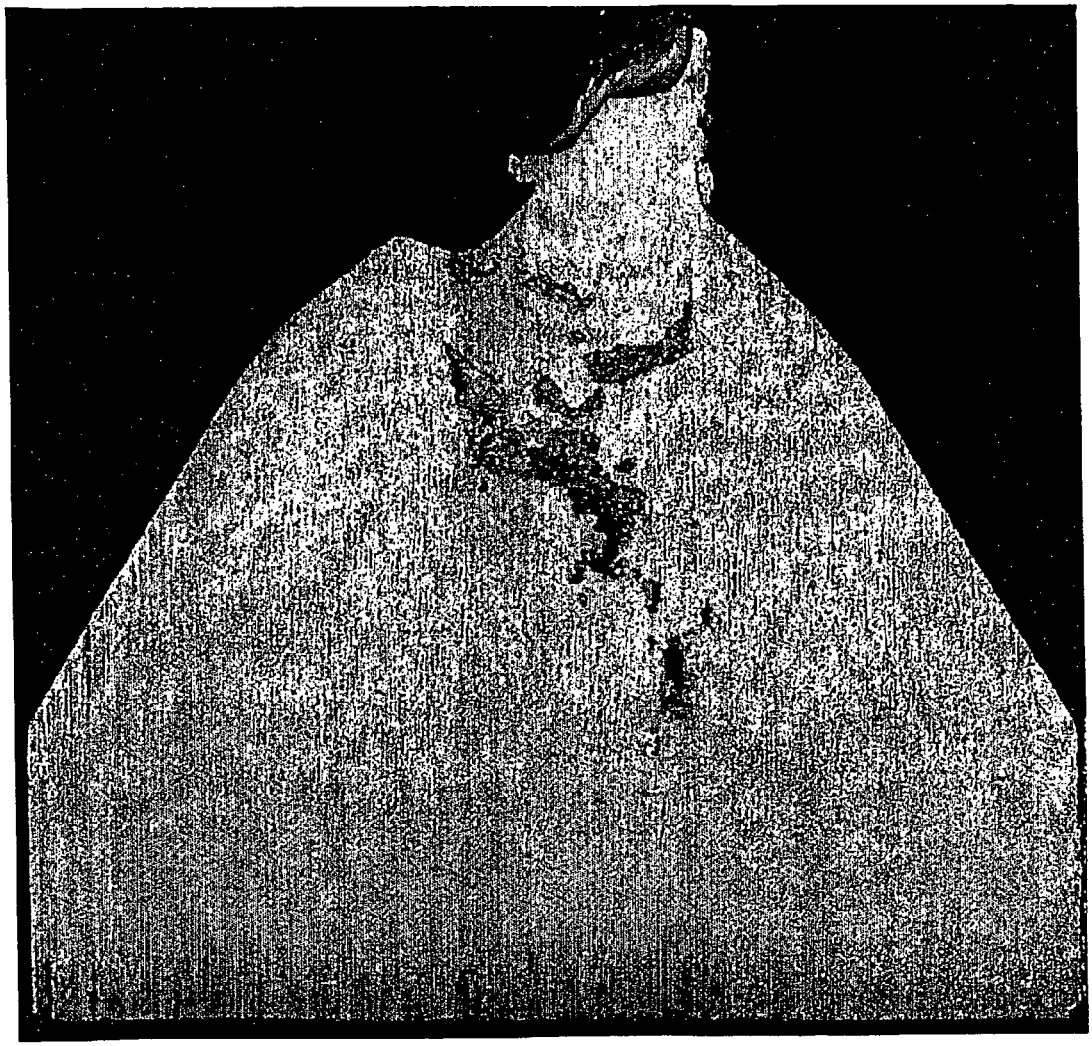
Figure 4D:
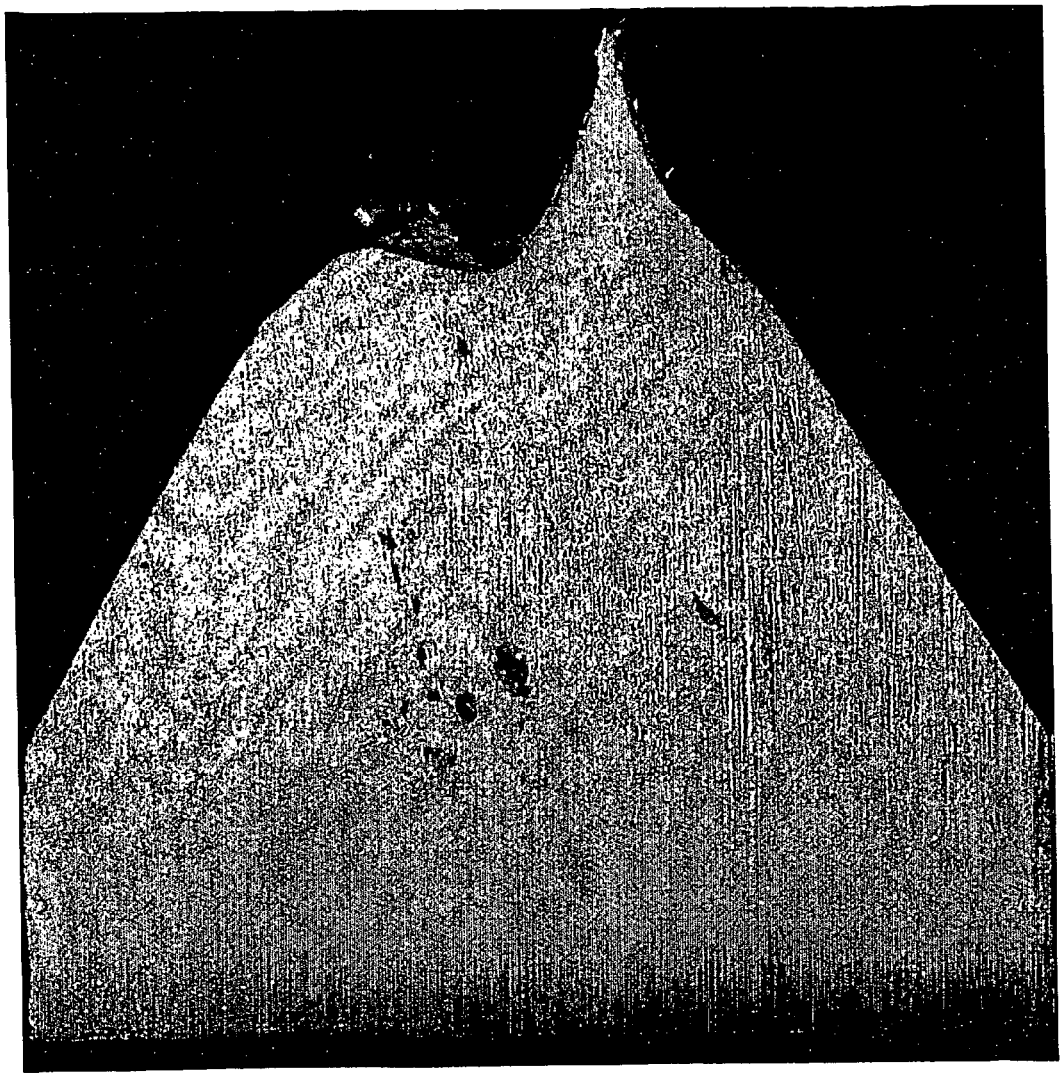

While the $CrB_x$-bearing trial alloy has demonstrated its effectiveness in promoting eutectic nucleation, both $TiSi_x$ and $MnC_x$-bearing master alloys have shown negligible effect. The trial master alloys have also been characterized. Table 1 summarizes the chemical compositions of these trial master alloys. In Table 1, while the atomic ratio of Cr to B for $CrB_x$-bearing master alloy is very close to the stoichiometric value for $CrB_2$, the compositions of both the $TiSi_x$ and the $MnC_x$-bearing master alloys are far away from the theoretical values for the targeted particles. Therefore, no targeted particles are expected to be present in these alloys. FIG. 2 shows the microstructures of the trial master alloys. Therefore absence of potent nucleating particles with a desirable size distribution in the master alloys must be responsible for the weak effects observed for these trial master alloys. This is because eutectic silicon can nucleate only on specific nucleating particles. Therefore, tests have been conducted with direct addition of the potential nucleating particles.

TABLE 2

| Chemical compositions of trial master alloys | | | | | |
|---|---|---|---|---|---|
| CrB-bearing master alloy, R2513A | | MnC-bearing master alloy, R2514A | | TiSi-bearing master alloy, Z6904C | |
| Alloying Element | % | Alloying Element | % | Alloying Element | % |
| B | 0.81 | C | 0.012 | Ti | 11.75 |
| Cr | 1.78 | Cr | 0.03 | Si | 9.97 |
| Fe | 0.11 | Fe | 0.06 | Fe | 0.85 |
| K | 0.1 | Mn | 4.92 | Zr | 0.46 |
| Si | 0.04 | Ni | 0.02 | V | 0.14 |
| Ti | 0.11 | Sr | 0.01 | Ni | 0.02 |
| Sr | 0.01 | Al | Balance | Cr(K) | 0.03 (0.04) |
| Al | Balance | Atomic Mn:C Ratio | 89.64 | Al | Balance |
| Atomic Cr:B Ratio | 0.46 | | | Atomic Ti:Si Ratio | 0.69 |

EXAMPLE 2

Phosphorous is a common trace impurity element in commercial aluminium. It originates from impurities in the alumina so that the potline Al contains somewhere around 5-20 ppm P. Phosphorous can also arise from the refractory furnace lining in melting and holding furnaces. It is well established that AlP is a good nucleus for silicon, and this is used commercially to grain refine primary silicon crystals in hypereutectic Al—Si alloys which contain silicon contents above about 12 wt %, and 18 wt % is common. In hypoeutectic alloys, it is suggested that the modifiers (such as Sr) neutralise the AlP particles, thereby reducing the eutectic nucleation frequency, although the effect has not received significant attention. It is therefore of interest to investigate whether it is possible to tailor specific combinations of P and Sr to achieve a high nucleation frequency together with a refined and fibrous Si morphology.

A phosphorus containing master alloy Al CuP having 19 wt % Cu, 79.6 wt %, 1.4 wt % was used as the nucleating agent after Sr modification.

Figure 5:
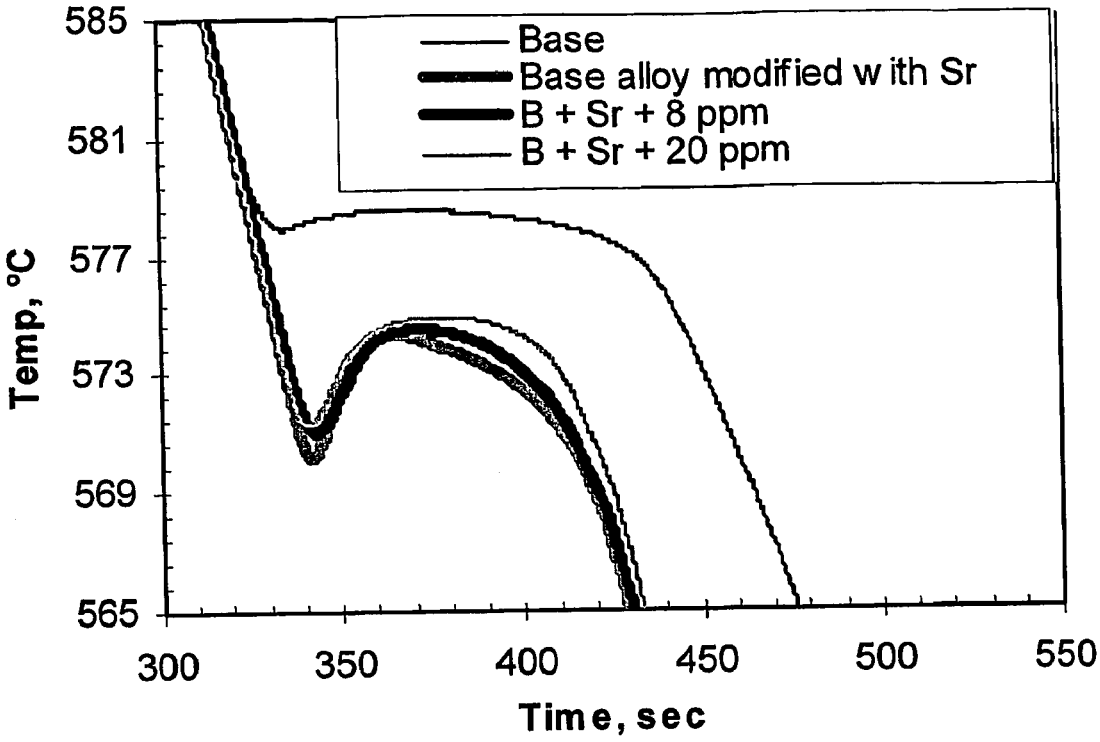
FIG. 5 illustrates cooling curves of the Sr modified melts with varying P additions.
Figure 6A:
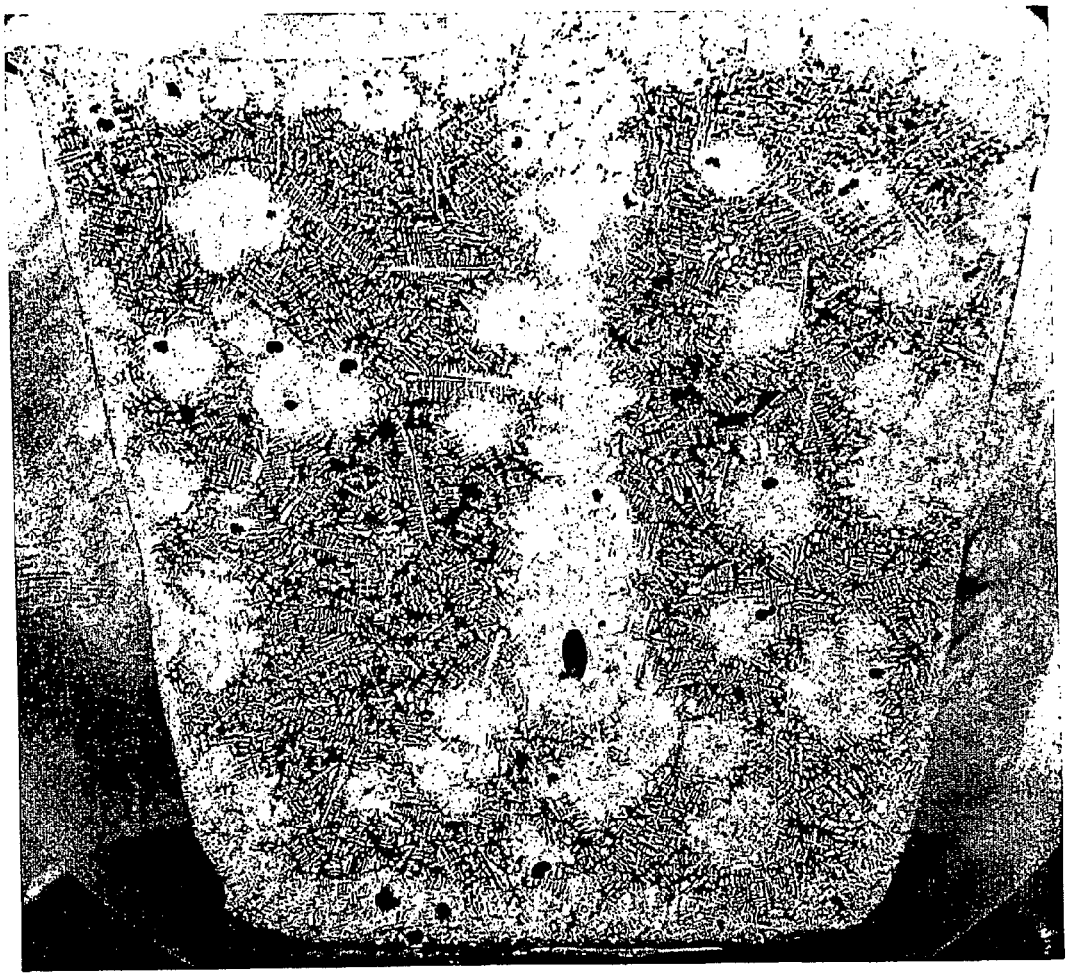
FIGS. 6(*a*)-6(*d*) are macrographs of samples quenched from different addition levels of B as Al-3% B to Sr modified alloy.
Figure 6B:
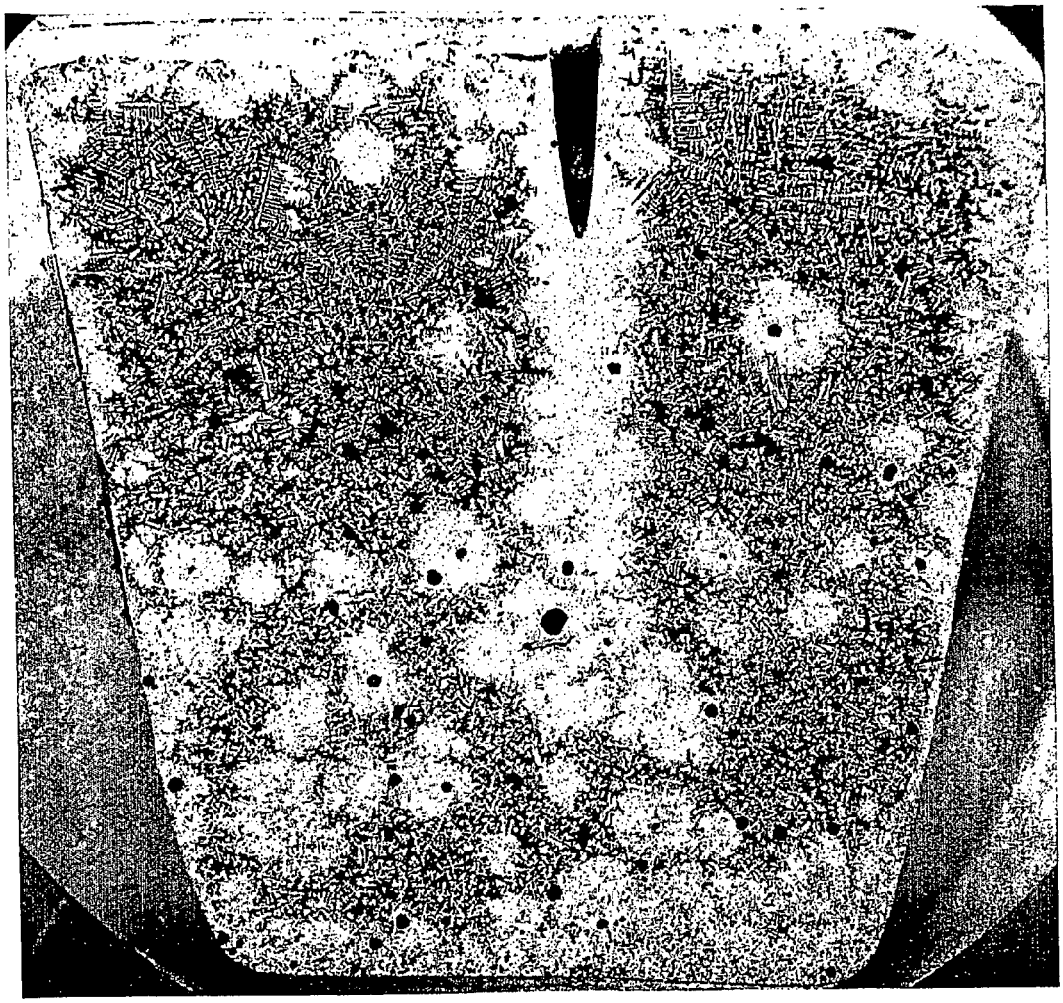
Figure 6C:
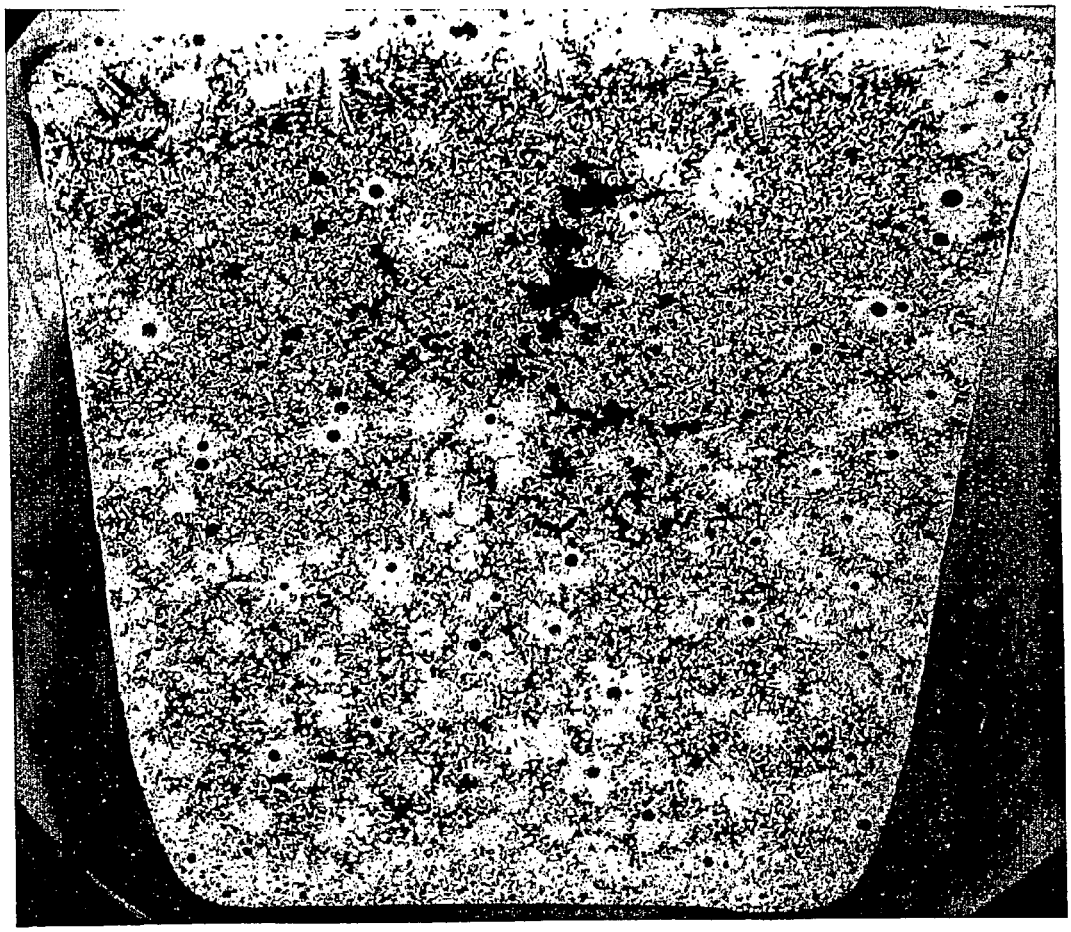
Figure 6D:
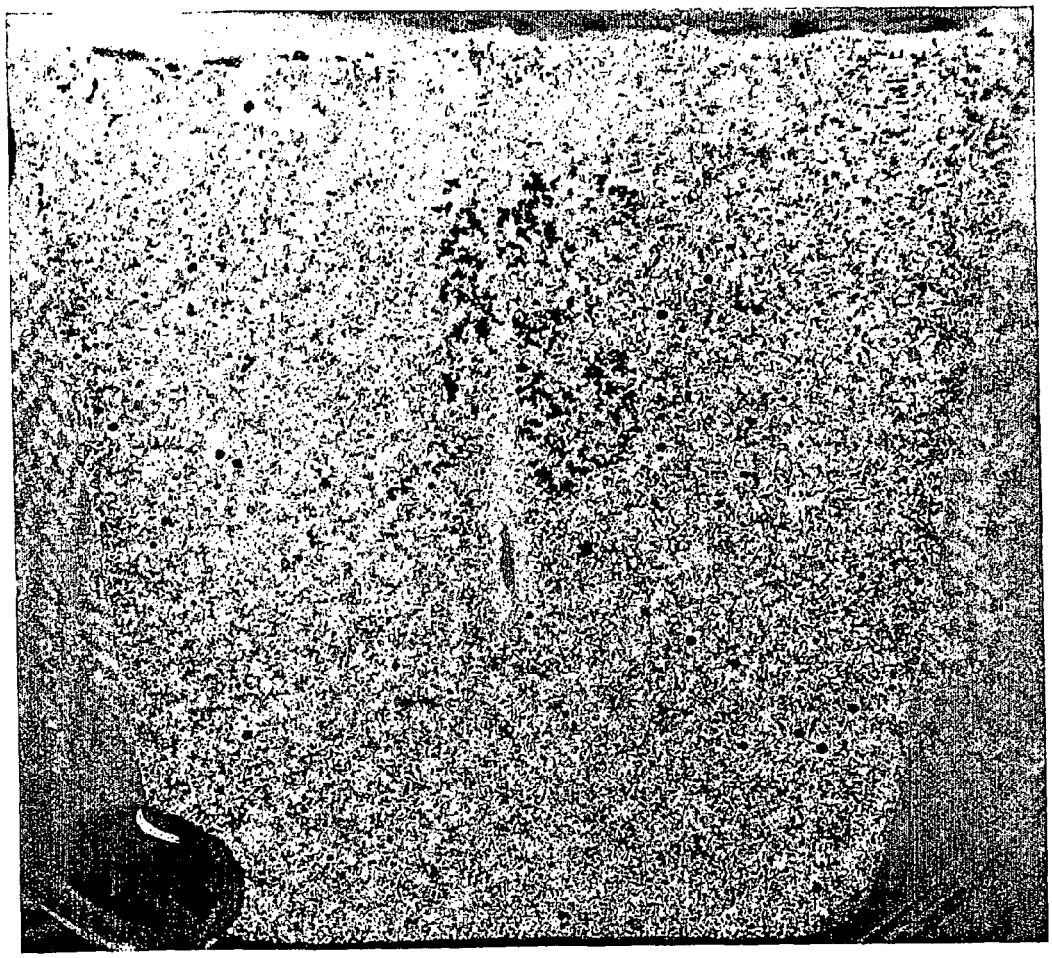
Figure 7A:
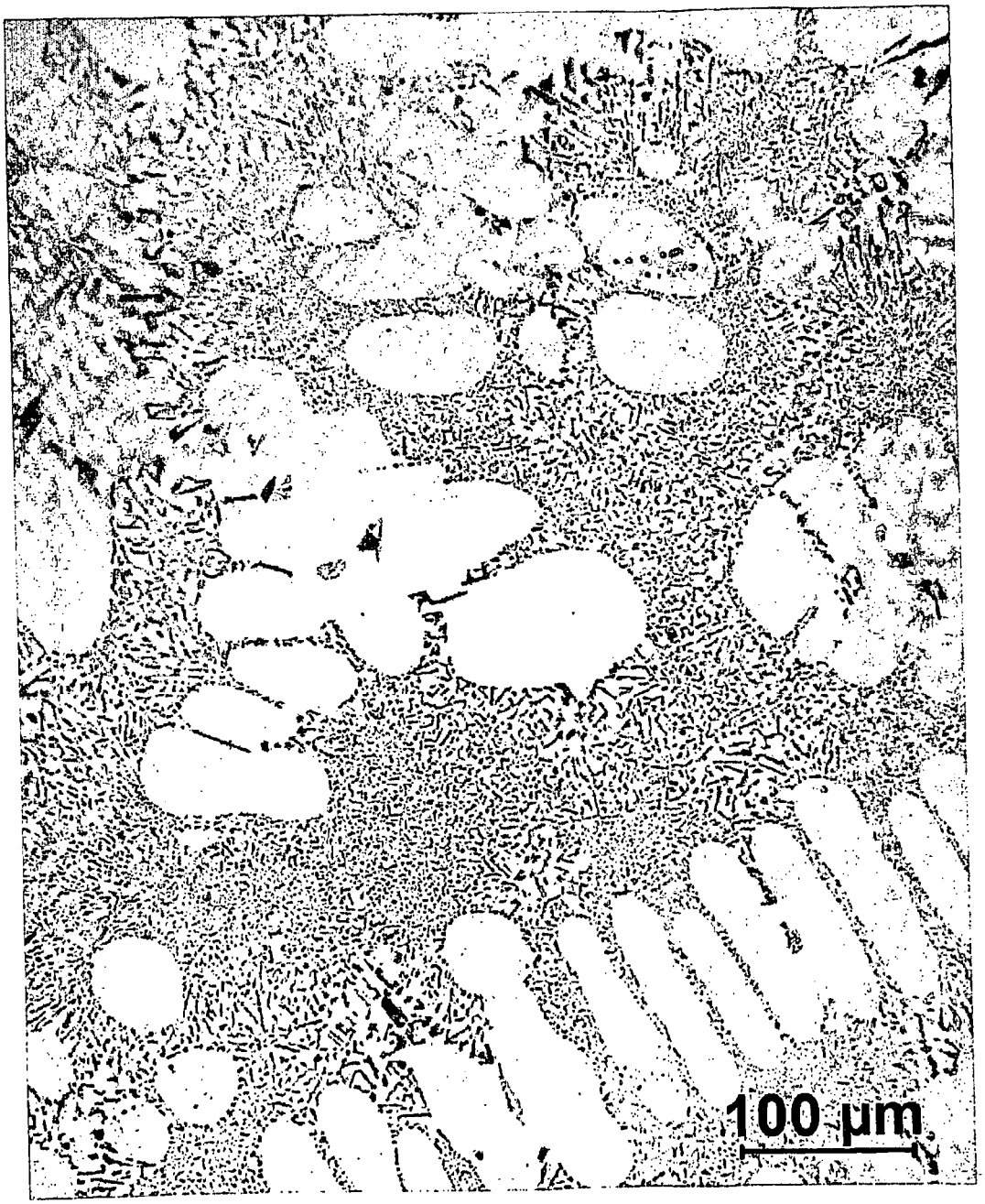
FIGS. 7(*a*)-7(*d*) are micrographs of the fully solidified samples of those shown in FIGS. 6(*a*)-6(*d*).
Figure 7B:
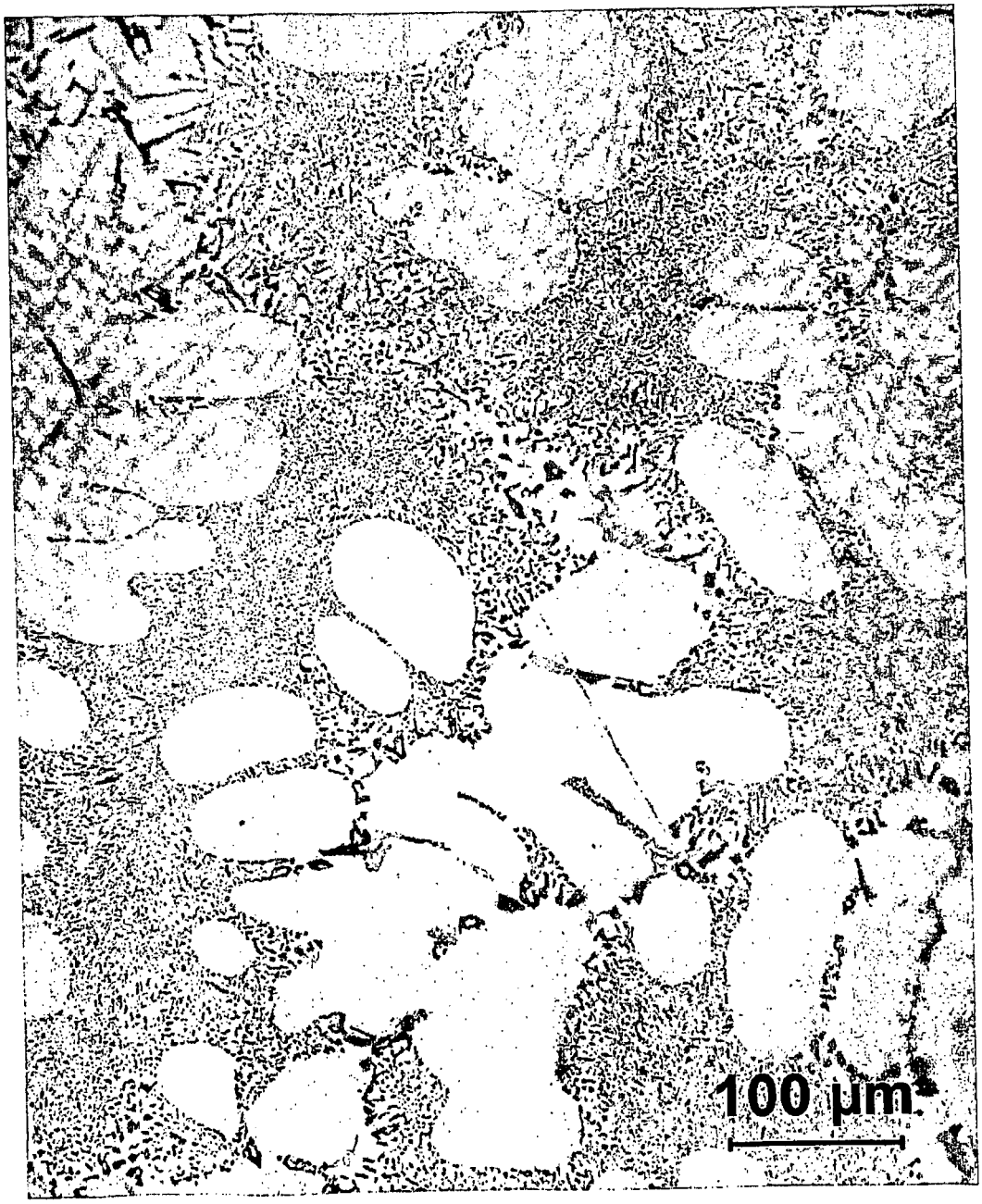
Figure 7C:
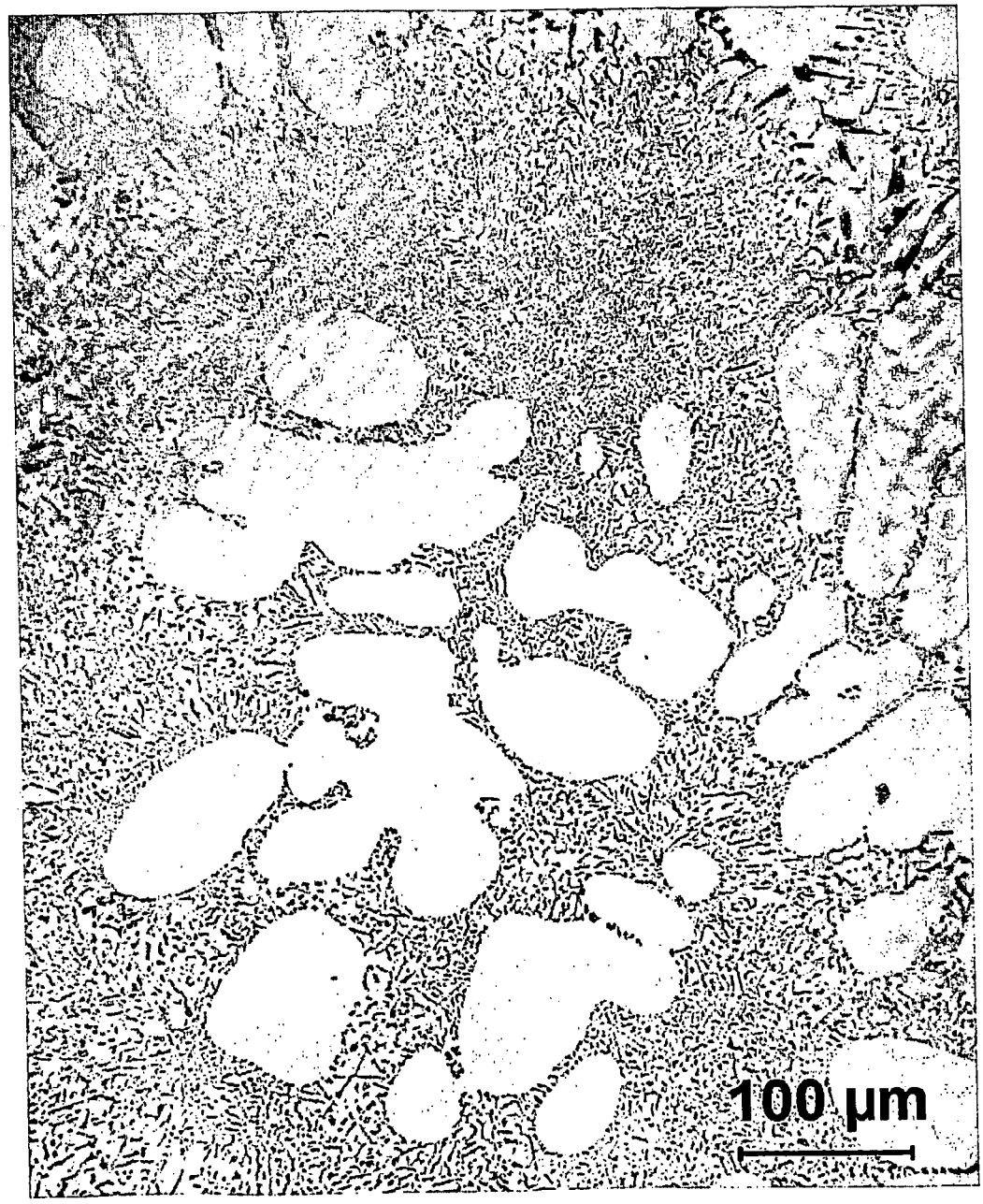
Figure 7D:
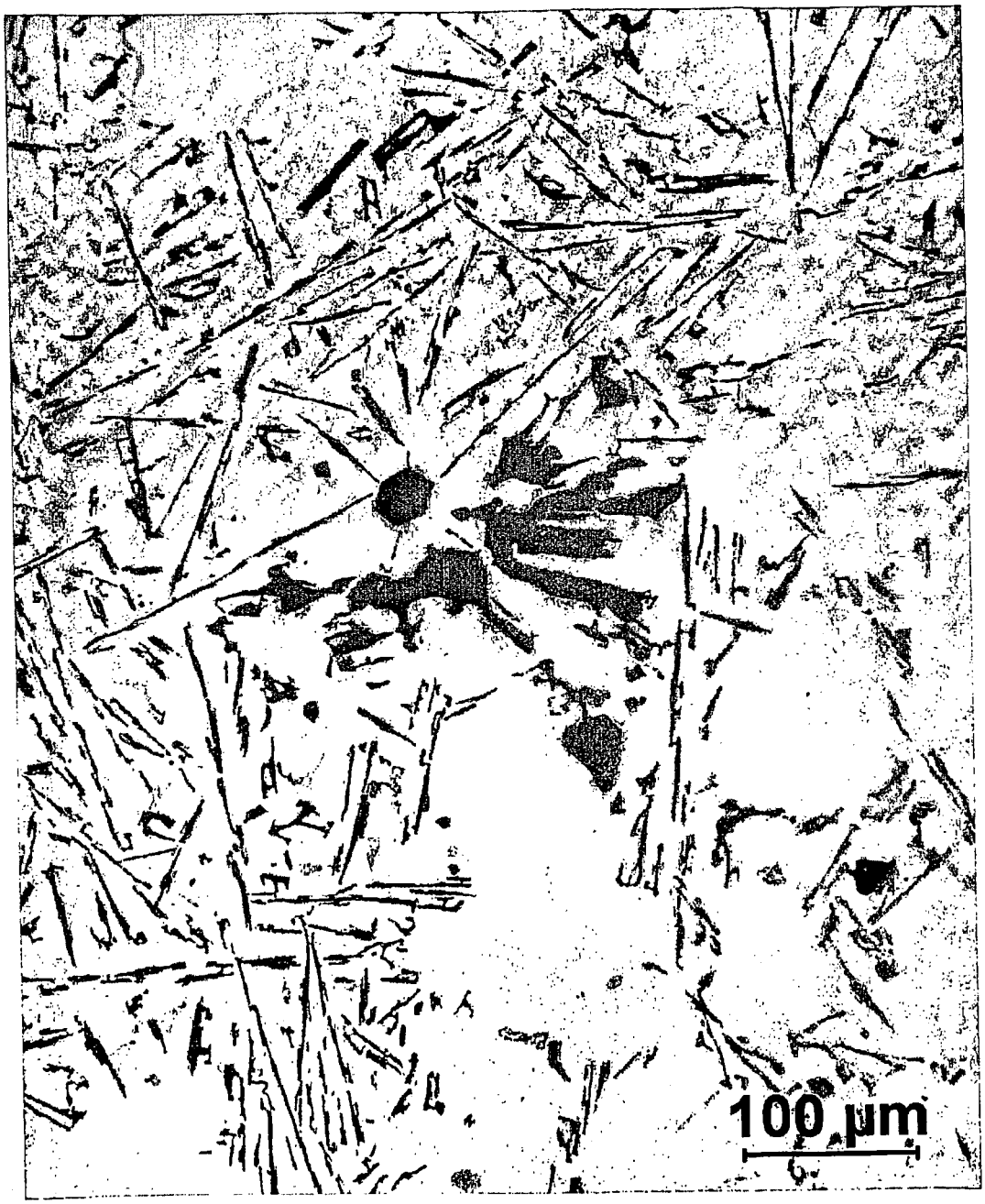

FIGS. 3(*a*), (*b*), (*c*), (*d*) shows the macrographs of samples quenched at halfway through the eutectic reaction and the micrographs of fully solidified samples with different levels of P in Sr-modified Al-10% Si alloys. FIGS. 3(*a*) and (3(*b*) are the macrograph and micrograph respectively of the base alloy modified with 150 ppm Sr with 8 ppm P addition. FIGS. 3(*c*) and (*d*) are the micrograph and macrograph of the base alloy modified with 150 ppm Sr with 20 ppm P addition. It is clear from the macrographs that the eutectic nucleation frequency is increased considerably with addition of P to the Sr-modified melts. Furthermore, as demonstrated by the micrographs of fully solidified samples, the Si morphology is well modified even at 20 ppm P. FIG. 5 shows the cooling curves of the alloys with different levels of P, showing a strong depression in eutectic growth temperature even at 20 ppm P, which agrees with the microstructural observations above. Two more similar sets of experiments with P contents ranging from 0 to 150 ppm have been conducted. These experiments show that while similar results were obtained as in the low P range, high P addition is detrimental because of loss of modification of silicon. Therefore it is possible to refine eutectic colonies while keeping a well-modified structure by addition of an appropriate amount of P into Sr-modified melts.

Samples of the aluminium-silicon melts with varying additions of Sr and P were subjected to Tatur test casting. The melts were cast as unmodified Al—Si, 150 ppm Sr modified Al—Si alloy with zero, 8 ppm and 30 ppm additions of phosphorus. FIG. 4(*a*) are macrographs for (a) base alloy, (b) base alloy modified with 150 ppm Sr, (c) alloy of (b) with 8 ppm P and (d) alloy of (b) with 30 ppm P.

As can be seen from FIGS. 4(*a*)-(*d*), the addition of 150 ppm Sr to the Al—Si melt improved the porosity. However remarkable improvements in porosity was obtained by increasing additions of phosphorus to the Sr modified melts.

The exact balance of P and Sr addition for optimising the porosity performance of alloys, while maintaining a well modified eutectic depends on the casting conditions and local cooling rate of the casting.

EXAMPLE 3

From the work with additions of Ti-bearing master alloys into Sr-modified melts, it is understood that aluminium boride may be a potent nucleus for the eutectic colonies. Therefore experiments have been conducted with addition of Al-3% B master alloy into Sr-modified melts. One repetitive run was conducted and the results appear very promising. The Ti and B containing master alloys used as the Al B producing nucleating agent were commercially available alloys Tibor and Tibloy having the composition set out in Table 3.

| Tibor | % | Tibloy | % |
|---|---|---|---|
| Ti | 4.5-5.5 | Ti | 1.5-1.7 |
| B | 0.9-1.1 | B | 1.3-1.5 |
| Fe | 0.3 max | Fe | 0.3 max |
| Si | 0.3 max | Si | 0.3 max |
| V | 0.2 max | V | 0.2 max |
| Others | Not specified | Others each 0.04 | Total 0.10 |

The impurity level of Ti in the liquid alloys did not affect the effectiveness of the nucleating particles for this invention. For some of tests where Tibloy was used, the Ti concentration in the melt can reach up to about 1000 ppm.

Figure 8:
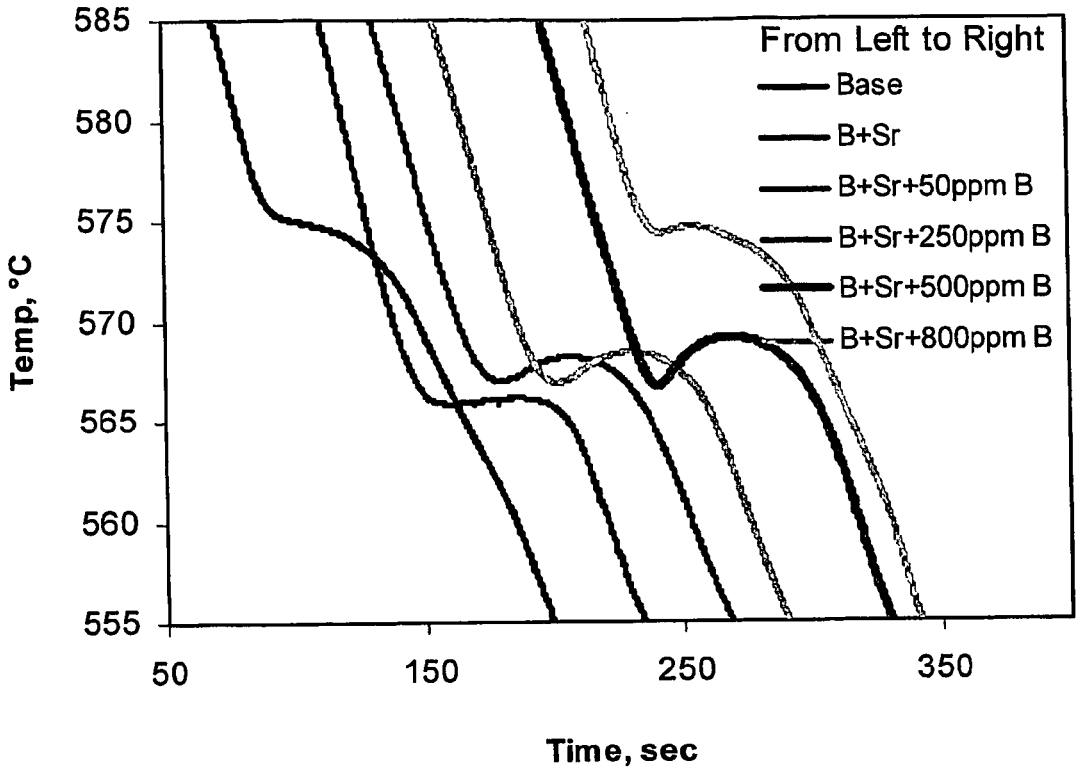
FIG. 8 is cooling curves measured of the samples shown in FIGS. 6(*a*)-6(*d*) and 7(*a*)-7(*d*)

FIGS. 6(*a*)-(*d*) and 7(*a*)-(*d*) show the macrographs of samples quenched halfway through the eutectic reaction and the micrographs of fully solidified samples, respectively. FIGS. 6(*a*) and 7(*a*) are the base alloy modified with 300 ppm Sr with 50 ppm B addition. FIGS. 6(*b*) and 7(*b*), the Sr modified base alloy with 250 ppm B, FIGS. 6(*c*) and 7(*c*), the Sr modified base alloy with 500 ppm B and FIGS. 6(*d*) and 7(*d*), 800 ppm B addition. It is clear from the macrographs that the eutectic nucleation frequency is increased with increasing addition of Al-3% B master alloy. Furthermore, as demonstrated in the micrographs of fully solidified samples, the Si morphology is still well modified even at 500 ppm B. Further addition of B will deteriorate the eutectic Si. FIG. 8 shows the cooling curves of the alloys corresponding to the samples in FIGS. 7(*a*)-(*d*), showing a strong eutectic depression even at 500 ppm B, which agrees with the microstructural observations above. Therefore this experiment again shows that it is possible to refine eutectic colonies while keeping a well-modified structure by addition of an appropriate amount of $AlB_x$ into Sr-modified melts.

Among the three trial master alloys, the $CrB_x$-bearing alloy is effective in promoting the eutectic nucleation, while $TiSi_x$- and $MnC_x$ bearing master alloys have only negligible effect. Absence of the potent nucleating particles with a right size distribution in the master alloys is suspected of being responsible for the weak effects observed for these trial master alloys.

The applicants have concluded that it is possible to refine eutectic colonies while keeping a well-modified eutectic structure by additions of an appropriate amount of AlP, $CrB_x$ and $AlB_x$ into Sr-modified melts. Given the right size distribution, $TiSi_x$ and $MnC_x$ could also be used effectively. Melts modified by other eutectic modifying elements such as sodium, antimony, barium, calcium, yttrium, lithium, potassium, and rare earth elements such as ytterbium, europium and mischmetal, such as lanthanum, cerium, praseodynium and neodynium used for eutectic modification are also able to benefit from the addition of these nucleant particles.

Figure 9:
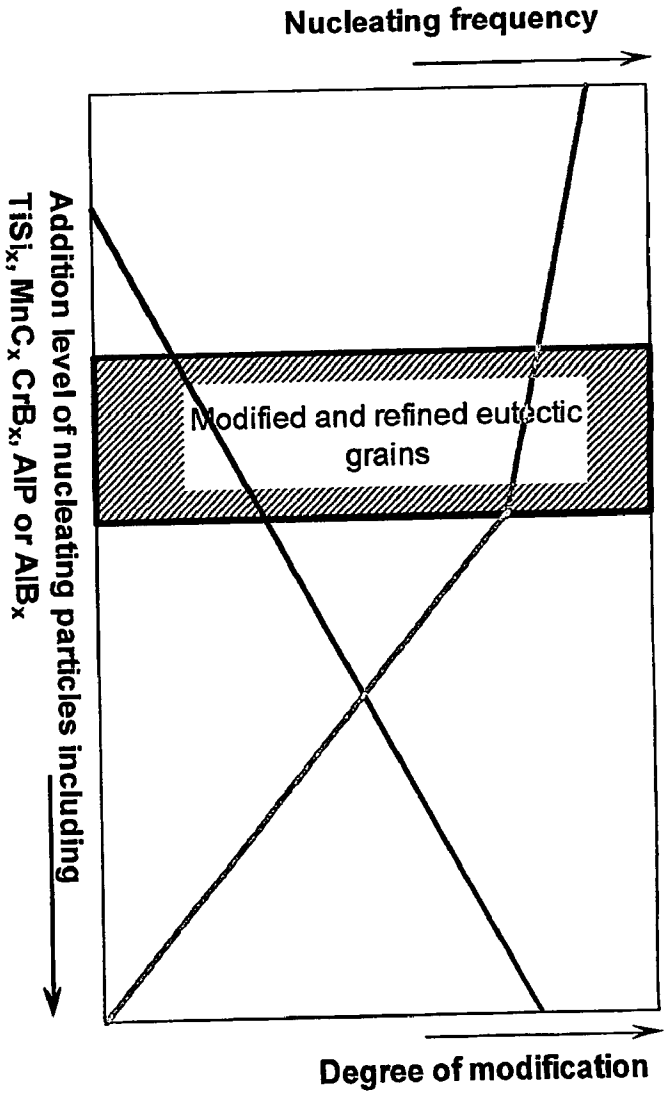
FIG. 9 is a schematic diagram illustrating the effect of addition of $CrB_x$, P and $AlB_x$ on nucleation frequency and degree of modification.

The schematic illustration in FIG. 9 summarises the key findings behind this invention. It shows, first, that the nucleation frequency of eutectic grains increases with increasing addition of nucleating particles for the eutectic, eg. $TiSi_x$, $MnC_x$, $CrB_x$, P, $AlB_x$, ie. the eutectic grain size decreases with addition of these nucleants. The degree of modification as given by the fineness of the eutectic silicon, decreases with the addition of nucleating particles, but decreases first slowly and then more rapidly. The refinement of the eutectic is still very good at intermediate addition levels of nucleant particles, and therefore the optimum operating window is therefore given by the best combination of a refined eutectic with a small eutectic grain size.

The invention claimed is:

1. A method of forming a hypoeutectic aluminium silicon alloy including the steps of:

forming an aluminium melt comprising greater than zero and less than about 12 wt % silicon, adding 20-3000 ppm of a eutectic modifying element selected from the group consisting of strontium, sodium, antimony, barium, calcium, yttrium, lithium, potassium, ytterbium, europium and mischmetal; and either adding nucleant particles and/or causing nucleant particles to be formed in the melt, the nucleant particles being $CrB_X$ wherein x is an integer of 1 or 2.

2. The method of claim 1 wherein the nucleant particles are added to the melt after the addition of the modifying element, the nucleant particles having a particle size range less than 100 μm.

3. The method of claim 2 wherein the nucleant particles have a particle size less than 10 μm.

4. The method of claim 1 wherein the modifying element is strontium.

5. The method of claim 1 wherein the eutectic modifying element is added at an addition rate of 150-3000 ppm, the eutectic modifying elemented selected from strontium, sodium, antimony, barium, calcium, yttrium, lithium, potassium, ytterbium, europium and mischmetal.

6. A method of forming a hypoeutectic aluminium silicon alloy including the steps of:

forming an aluminium melt comprising greater than zero and less than about 12 wt % silicon, adding 20-3000 ppm of a eutectic modifying element selected from the group consisting of strontium, sodium, antimony, barium, calcium, yttrium, lithium, potassium, ytterbium, europium and mischmetal; and either adding nucleant particles and/or causing nucleant particles to be formed in the melt, the nucleant particles being $CrB_X$ wherein x is an integer of 1 or 2;

wherein the $CrB_X$ nucleant particles are added to the melt in a $CrB_X$ bearing alloy, the addition rate of $CrB_X$ exceeding 2 wt %.

7. An aluminium silicon hypoeutectic alloy comprising:

less than about 12 wt % silicon, 20-3000 ppm of a eutectic modifying element selected from the group consisting of strontium, sodium, antimony, barium, calcium, yttrium, lithium, potassium, ytterbium, europium and mischmetal; and balance aluminium and incidental impurities;

wherein eutectic grains are formed around nucleant particles being $CrB_X$ where x is an integer of 1 or 2.

8. An aluminium silicon hypoeutectic alloy comprising:

less than about 12 wt % silicon, 20-3000 ppm of a eutectic modifying element selected from the group consisting of strontium, sodium, antimony, barium, calcium, yttrium, lithium, potassium, ytterbium, europium and mischmetal; and balance aluminium and incidental impurities;

wherein eutectic grains are formed around nucleant particles being $CrB_X$ where x is an integer of 1 or 2;

wherein the $CrB_X$ is present as particles for eutectic growth in an amount greater than 2 wt %.

9. A method for producing an as cast material comprising the steps of:

casting a hypoeutectic alloy;

wherein the hypoeutectic alloy consists essentially of:

less than about 12 wt % silicon, 20-3000 ppm of eutectic modifying element selected from the group consisting of strontium, sodium, antimony, barium, calcium, yttrium, lithium, potassium, ytterbium, europium and mischmetal; and balance aluminium;

wherein eutectic grains are formed around nucleant particles being $CrB_X$ where x is an integer of 1 or 2; and producing a cast material.

10. A method of forming a hypoeutectic aluminium silicon alloy including the steps of:

forming an aluminium melt comprising greater than zero and less than about 12 wt % silicon, adding 20-3000 ppm of a eutectic modifying element selected from the group consisting of strontium, sodium, antimony, barium, calcium, yttrium, lithium, potassium, ytterbium, europium and mischmetal; and either adding nucleant particles and/or causing nucleant particles to be formed in the melt, the nucleant particles having a particle size range less than 100 μm, wherein the nucleant particles are $CrB_X$, where x is an integer of 1 or 2.

* * * * *

UNITED STATES PATENT AND TRADEMARK OFFICE

CERTIFICATE OF CORRECTION

PATENT NO. : 8,097,101 B2
APPLICATION NO. : 11/720729
DATED : January 17, 2012
INVENTOR(S) : A. K. Dahle et al.

It is certified that error appears in the above-identified patent and that said Letters Patent is hereby corrected as shown below:

On the Title page

Item (87) PCT Pub. No. & Date "PCT Pub. No.: WO2006/058388
PCT Pub. Date: Jun. 8, 2008"

should read

--PCT Pub. No.: WO2006/058388
PCT Pub. Date: Jun. 8, 2006--

Signed and Sealed this
Nineteenth Day of June, 2012

David J. Kappos

David J. Kappos
*Director of the United States Patent and Trademark Office*